United States Patent [19]

Rasmussen et al.

[11] 4,276,795

[45] Jul. 7, 1981

[54] FISH STICK CUTTING METHOD AND APPARATUS

[75] Inventors: Glenn Rasmussen, Champlin; Larry Huston, Buffalo, both of Minn.; Donald W. Morse, Rowley, Mass.; Takuzo Tsuchiya, St. Louis Park, Minn.; Clifton H. Morrison, St. Paul, Minn.; Stanley C. Rustad, Golden Valley, Minn.; Leo Eiden, New Hope, Minn.

[73] Assignee: General Mills, Inc., Minneapolis, Minn.

[21] Appl. No.: 60,952

[22] Filed: Jul. 26, 1979

[51] Int. Cl.[3] ..... B26D 1/06

[52] U.S. Cl. ..... 83/42; 83/160; 83/395; 83/419; 83/578; 83/622

[58] Field of Search ..... 83/578, 42, 395, 419, 83/622, 160

[56] References Cited

U.S. PATENT DOCUMENTS

| | | | |
|---|---|---|---|
| 2,583,940 | 1/1952 | Furlong | 83/395 X |
| 2,757,733 | 8/1956 | Cunningham | 83/578 |
| 3,851,554 | 12/1974 | Papai | 83/419 X |
| 3,893,214 | 7/1975 | Parkinson | 83/578 X |
| 3,996,037 | 12/1976 | Wythe | 83/578 X |

*Primary Examiner*—Frank T. Yost

*Attorney, Agent, or Firm*—Gene O. Enockson; L. MeRoy Lillehaugen

[57] ABSTRACT

A number of pairs of frozen fish slabs are arranged vertically in an equal number of laterally spaced vertical tubes or chutes constituting a magazine, each tube or chute having a partition dividing it into two open-ended compartments with a slab being slidably contained in each compartment. A cutter assembly comprising a blade carrier and a vertically adjustable table move as a unit at an acute angle beneath the magazine. The carrier has fixedly mounted at another acute angle thereon a plurality of flat blades equal in number to the number of tubes or chutes, each blade having a knife edge extending along opposite sides thereof so that when the cutter assembly is advanced in one direction the lower end of one of the slabs of each pair of slabs is severed and when retracted the lower end of the other of the slabs of each pair is severed to form individual fish sticks having a thickness determined by the distance the table is spaced below the plane in which the blades move. Whereas the thickness of the fish sticks is determined by the height of the table, the length and width thereof are determined by the cross section of the frozen slabs. The table has appropriately located openings therein so that the fish sticks gravitationally drop into angled troughs after they have been severed from the slabs. The fish sticks are then pushed from the angled troughs onto a conveyor in a uniformly-oriented manner suitable for food processing operations, such as breading and battering.

61 Claims, 24 Drawing Figures

16
150
64
62
152
154
64
62
210b
210a
66
182
210b
210a
220b
222
224a
226b
228
146
220a
222
226a
224a
232
234
236
230
128
130
134
126
128
130
14
14
12
10

150
152
104
104
100a
26
32b
30
32a
30
18
94a
98a
90a
94a
96a
100a
16
92a
106
106
102
12

152b
170b
152
104
18
30
32b
32a
20
20
38
50
36
26
34a
40a
50
38
30
46
46
42
44
48
58
40b
172b
34b
19
34a
48
44
42
64
56
60
58
56
54
62
20b
52
54
20a 16
180
154
26
26
18
180b
181a
19
181b
34b
36
34a
30
30
26
180a
180
26
32b
181a
32a
26
20a
34a
20b
64
38
176
38
174
19

STICK a CUT, a-DROPS
STARTING TO CUT STICK-a
STICK b CUT b-DROPS
STARTING TO CUT STICK b

FISH STICK CUTTING METHOD AND APPARATUS

BACKGROUND OF THE INVENTION

1. Field of the Invention

This invention relates generally to the cutting of frozen food, and pertains more particularly to a method and apparatus for slicing fish sticks from the lower ends of vertically arrayed slabs or logs of frozen fish or the like.

2. Description of the Prior Art

In the past, fish sticks have been sawed from the ends of frozen fish slabs or logs. It has been found, though, that the sawing action produces an appreciable amount of "sawdust" which, while being reclaimable, nonetheless reduces the number of sticks that can be obtained from each slab or log.

Owing to the loss by reason of the sawdust resulting from the sawing operation, although not a total loss, it is obvious that the reclaimed material does not bring the price that it would if the fish sticks could be cut without any significant loss. Inasmuch as the problem has been recognized previously, there have been produced power-operated cleavers or knives; one such prior art apparatus, which is known to us, has been disclosed in U.S. Pat. No. 3,867,858 granted on Feb. 25, 1975 to Tsuchiya et al. The drawback that has proved to be most noticeable as far as the alluded to prior art apparatus is concerned has been that the resulting fish sticks are disoriented and the randomly assumed positions make it more difficult as far as carrying out further processing operations, such as breading and battering the individual fish sticks.

Additionally, the patented apparatus mentioned above is restricted as far as the rate at which the sticks can be sliced from the frozen slabs or logs of fish. Still further, the apparatus, when employed to cut relatively thin fish sticks, does not assure that they will not have some curl present.

SUMMARY OF THE INVENTION

In commercial operations, it is important to mass produce fish sticks. Therefore, an object of our invention is to cut or sever a relatively large number of individual fish sticks from the ends of frozen slabs or logs of frozen fish.

Another object is to sever fish sticks in a manner such that they will be uniformly oriented for later processing.

Also, an object of our invention is to achieve a preferred lateral spacing of the fish sticks, and also to provide a desired longitudinal spacing, the longitudinal spacing being adjustable.

Another important object of our invention is to sever sticks from frozen fish slabs in which the severed fish sticks are of uniform thickness. More specifically, an aim of the invention is to mount a plurality of relatively flat blades in such a way that they will not bend or flex, thereby assuring fish sticks of uniform thickness.

Whereas the object mentioned just above is concerned with producing fish sticks of uniform thickness, it is also within the scope of our invention to form fish sticks having various thicknesses. In this regard, an aim of the invention is to provide a vertically adjustable table which can be positioned beneath the plane in which the blades move at whatever height is preferable for the batch of fish sticks then being cut. It is also a feature of the invention to be able to adjust the thickness of the fish sticks by lowering or raising the table, doing so without having to shut down the apparatus.

Yet another object of the invention is to provide apparatus that will be relatively low in cost, particularly inasmuch as the equipment need not be massive. For instance, when practicing the teachings of our invention, a relatively short stroke can be employed which will reduce the amount of inertia and thereby permit lighter weight parts to be employed.

Another important object of our invention is to move the cutting blades in such an angled direction that the severing action is achieved without undue impact and which is also accomplished in relatively short paths or strokes. More specifically, an aim of the invention is to not only angle the blades and hence their knife edges so as to initiate the cutting of the fish sticks from one corner, but it is also planned that the entire group of blades be moved angularly so as not to strike the various slabs in a broadside fashion.

Still further, an object of our invention is to provide a mounting of the blades such that a honing action automatically occurs as the blades are moved back and forth. In other words, the blades are mounted in such a way that they are self-sharpening.

Even though the table is adjustable vertically in order to vary the thickness of the fish sticks, an object of the invention is to hold the table at its adjusted elevation so that the table functions just as though it were permanently at the particular height at which it is set for a given fish stick thickness.

Rather briefly, our invention makes use of a plurality of vertically arranged tubes or chutes, there being a partition dividing each tube into two closely adjacent open-ended compartments. When a slab of frozen fish or the like is inserted through the open upper end of each compartment, it is slidable downwardly onto either a flat blade, there being one such blade for each tube and hence for each pair of frozen fish slabs, or when the blades are not directly under the fish slabs in one side of each tube, the slab in the other side or open-ended compartment is free to slide downwardly onto a vertically adjustable table. Although the height of the table can be selected so as to sever the fish sticks from the lower ends of the frozen slabs such that they have a desired thickness, provision is made for clamping the table at its adjusted height so that the adjusting mechanism does not have to shoulder the downward forces created by the cutting action.

When severing the fish sticks, the blades are moved in unison at an angle with respect to the lower ends of the vertical tubes. Coupled with the angulation of the blades themselves on the carrier, there is a combined acute angle at which the blades are advanced in one direction to effect a cutting of fish sticks, and when moved in a reverse direction the blades are retracted or withdrawn through the same acute angle. By angling both the blades and the direction in which they are advanced and retracted, the slabs are more efficiently and effectively cut to produce the various fish sticks.

Provision is made for the fish sticks, after they have been severed from the lower ends of the frozen slabs, to fall through appropriately positioned openings or holes in the adjustable table. Also, reduced or relieved portions of the table residing between the openings or holes, the relieving being of the same thickness as the blades, enable the blades to cut without imparting curl to the resulting fish sticks. Also, vertical surfaces adjacent the lower ends of the tubes or chutes containing the frozen slabs therein function as reactive members which shoulder or absorb the lateral and longitudinal pressure or forces resulting from the cutting action, thereby minimizing the likelihood of the slabs breaking off during the cutting or severing action. Consequently, the resulting fish stick in each instance is uniformly dimensioned and is also uniformly oriented when it is dropped through the openings or holes in the table, falling into angled troughs while still assuming their uniformly oriented relationship. Provision is made for pushing the individual fish sticks from their respective angled troughs onto a conveyer belt for conveying to a processing station where they can be breaded and battered while still uniformly oriented.

BRIEF DESCRIPTION OF THE DRAWINGS

FIG. 1 is a top plan view of apparatus illustrating our invention and showing a number of fish sticks being conveyed for further processing, portions of the apparatus at one end being removed in order to depict parts that would otherwise be concealed;

FIG. 6 is an end elevational view taken in the direction of line 6—6 of FIG. 4 for the purpose of showing to better advantage the manner in which the table is adjusted and also showing the angled troughs which serve as a collector for the severed fish sticks, several of the pushers which shove the fish sticks from the angled troughs being pictured at the left;

FIGS. 16, 17, 18 and 19 are diagrammatic views depicting the manner in which two fish sticks are severed, and FIG. 20 is an enlarged sectional view taken in the direction of line 20—20 of FIG. 16 so as to show even more clearly how the cutting of a fish stick is accomplished.

DESCRIPTION OF THE PREFERRED EMBODIMENT

Figure 2:
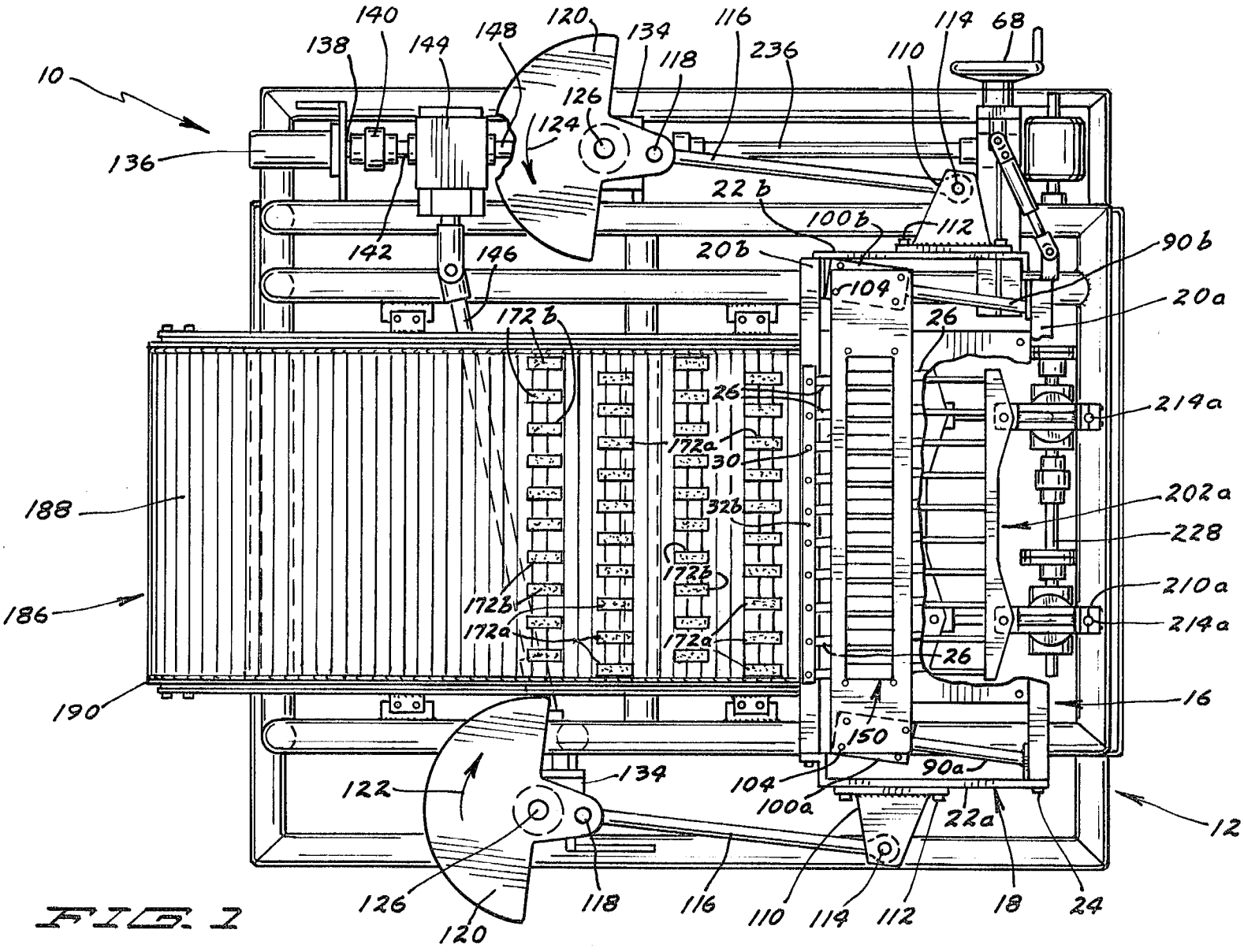
FIG. 2 is a side elevational view corresponding to FIG. 1.
Figure 2:
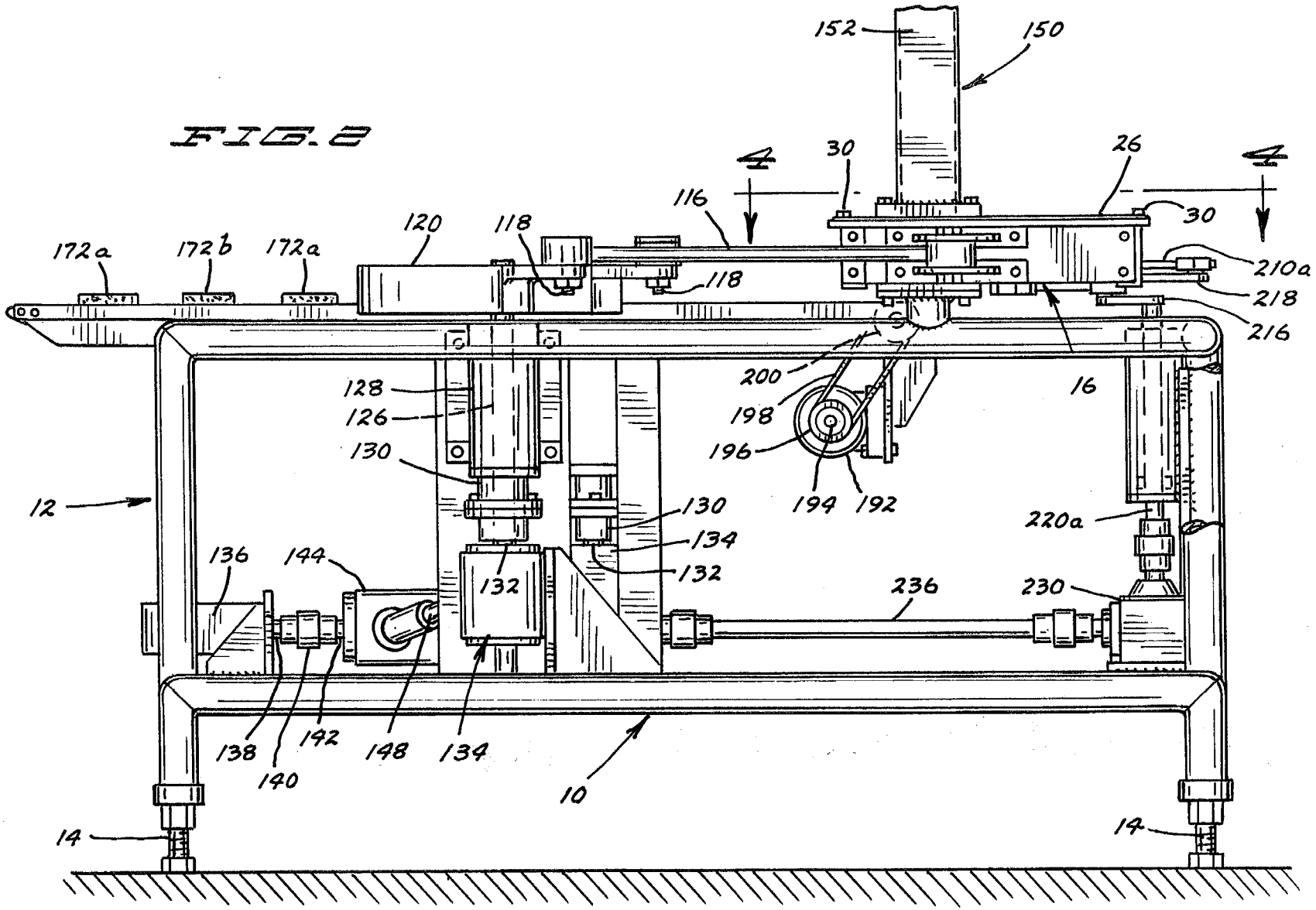
Figure 3:
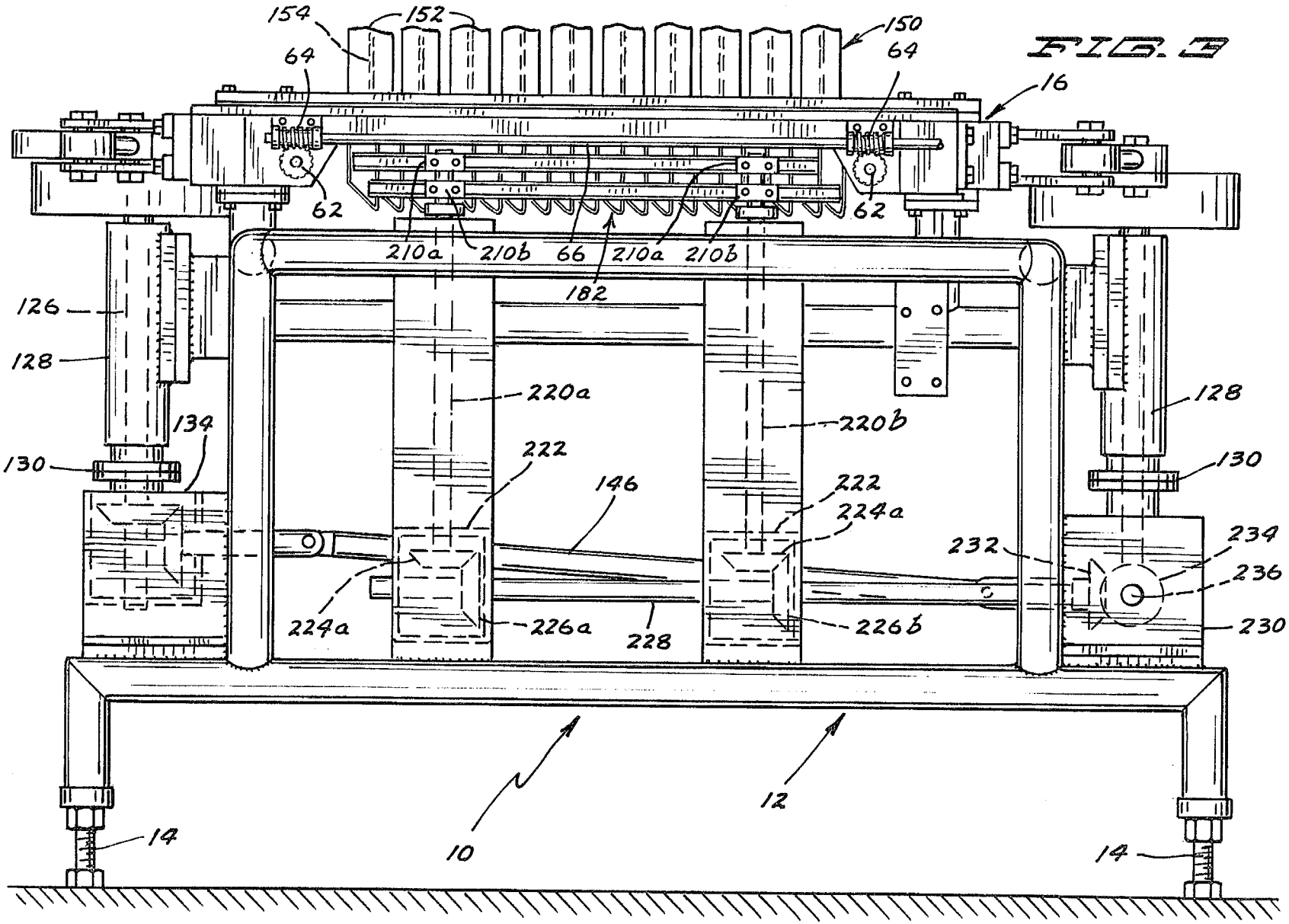
FIG. 3 is an end elevational view taken from the right in FIGS. 1 and 2.

Apparatus characterizing our invention has been denoted generally by the reference numeral 10 in FIGS. 1, 2 and 3. Included in the apparatus is a frame indicated by the reference numeral 12, the frame being composed of a number of tubular members lending support for various mechanisms hereinafter described. It might be well, though, to mention the feet labeled 14; these feet constitute leveling bolts so that by individually adjusting the feet, the entire apparatus can be leveled, although precise leveling of the apparatus is not a prerequisite.

Playing a very important role in the aforenoted objects of our invention is what will be termed a cutter assembly 16 comprising a blade carrier 18 and a table 19 disposed therebeneath; as will become manifest later on, the blade carrier 18 and the table 19 are reciprocated in unison via a rectilinear path which traverses an acute angle.

Figure 9:
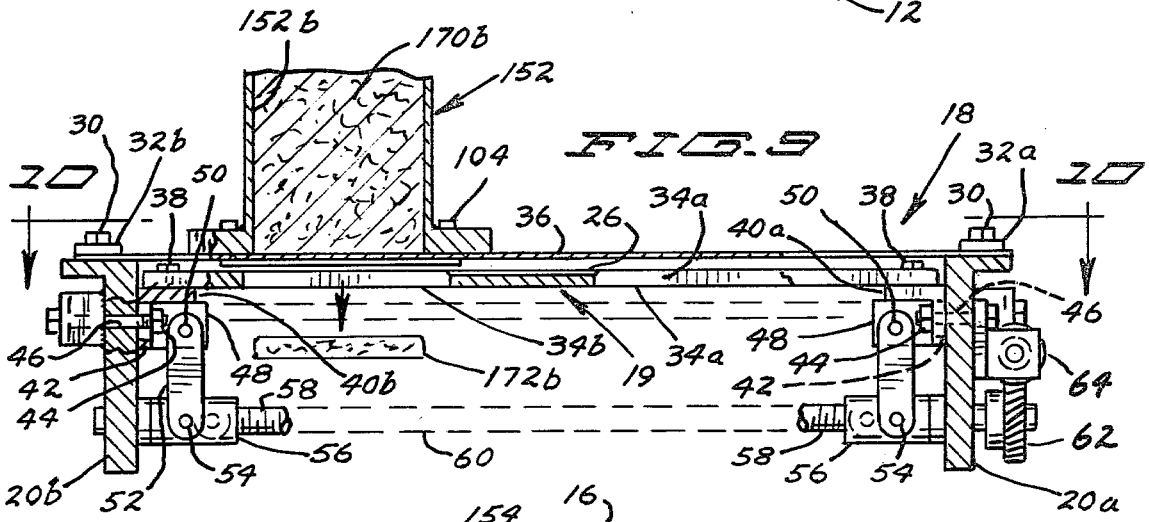
FIG. 9 is a sectional view taken in the direction of line 9—9 of FIG. 4, the direction being via an offset path in order to not only depict the manner in which the table is raised and lowered but also to show the cross sectional makeup thereof which virtually eliminates any curling of the fish stick during the severance thereof from the lower end of a frozen fish slab.

Describing the blade carrier 18, it can be explained that the carrier includes a pair of angle members **20*a* and 20*b*, the angled configuration thereof being best understood from FIG. 9. The angles 20*a*, 20*b* are held in a spaced relation by means of brackets 22*a*, 22*b* fastened to the ends of the angles 20*a*, 20*b* through the agency of bolts indicated by the reference numeral 24. Thus, it will be appreciated that the two angle members 20*a*, 20*b* and the two brackets 22*a*, 22*b*** constitute a box or rectangular frame unit.

As the name of the carrier 18 implies, it is utilized for carrying a plurality of blades 26. In the illustrative situation, ten such blades are employed; of course, the specific number is not critical to a practicing of the invention. From the cross sectional makeup of FIG. 7, and even more vividly from FIG. 20 which is also in section, it will be discerned that each blade 26 has a beveled knife edge **28*a* and 28*b* formed along each side thereof. It can also be mentioned at this stage that the knife edges 28*a*, 28*b* are parallel to each other. Furthermore, the upper surface of each blade 26 is flat and also its lower surface is flat, the lower surface being somewhat less extensive than the upper surface by reason of the beveled knife edges 28*a*, 28*b***.

Figure 13:
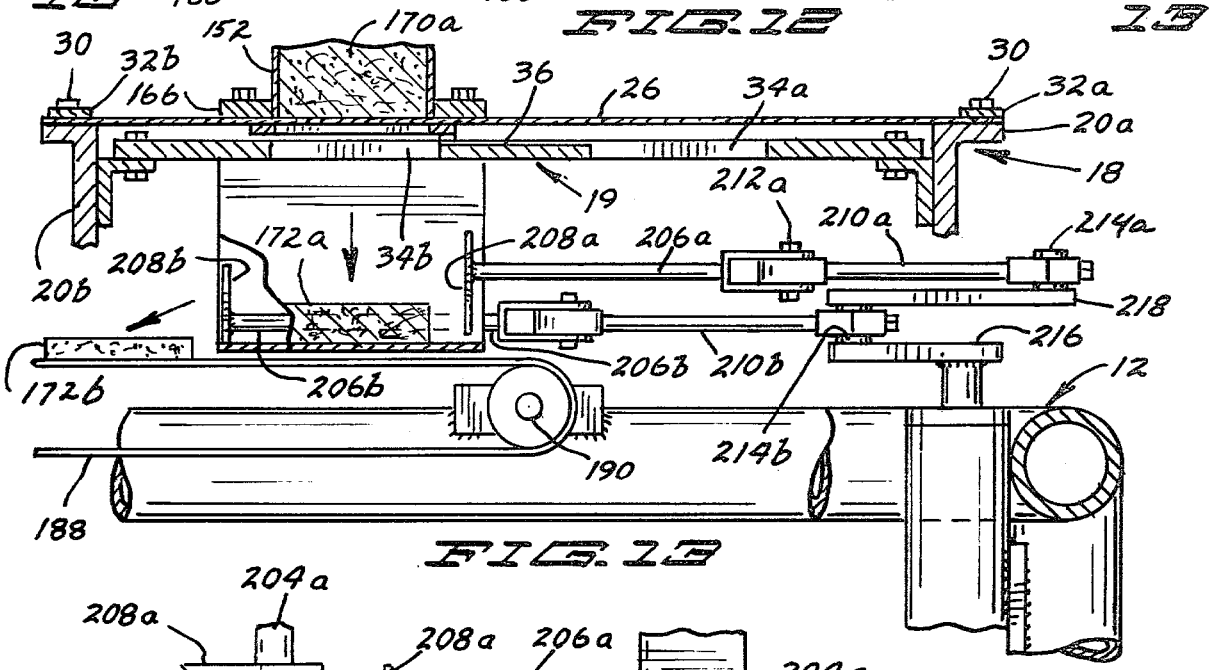
FIG. 13 is a sectional view taken in the direction of line 13—13 of FIG. 12, the view not only showing how one pusher is actuated but additionally showing how a fish stick is severed from the lower end of a frozen fish slab.

The blades 26 are attached to the horizontal flanges of the angle members **20*a*, 20*b* by means of bolts 30 which extend downwardly through clamping or hold-down strips 32*a*, 32*b* which overlie the opposite ends of the various blades 26. Inasmuch as the horizontal flanges of the angle members 20***a*, 20*b* appear in FIGS. 9 and 13, perhaps the manner in which the blades 26 are held fast with respect to the angle members 20*a* and 20*b* can best be appreciated from these two views; however, the clamping or hold-down strips 32*a*, 32*b* are clearly visible in other views, such as FIGS. 4 and 5.

While the manner in which the blades 26 are held in place should be fully comprehended from what has been said above, it will not be readily apparent from the information that has been given that the blades 26 are all mounted at an acute angle of 2°. The diagrammatic view appearing in FIG. 16, which will be referred in detail to hereinafter, depicts the 2° angulation of the particular blade 26 appearing in this figure. Close inspection of FIGS. 4 and 5 will also show the angulation of 2°, which incidentally is exaggerated somewhat so that it is perceptible.

Presently, it will be explained how the blade carrier 18 is actuated so as to advance and retract the blades 26 in a horizontal plane, it can be stated at this time that the table 19 is disposed beneath the blade carrier 18 and is vertically adjustable in a manner presently to be described. As a point of passing interest, the thickness of the blades 26 is $\frac{1}{8}$ inch, whereas the thickness of the table 19 is $\frac{3}{8}$ inch. The table 19 in actual practice is a sheet of steel plate formed with a first set of holes or openings 34*a* and a similar second set of such holes or openings 34*b*. These openings 34*a* and 34*b*, as far as their layout is concerned, can readily be seen in FIG. 11.

Figure 11:
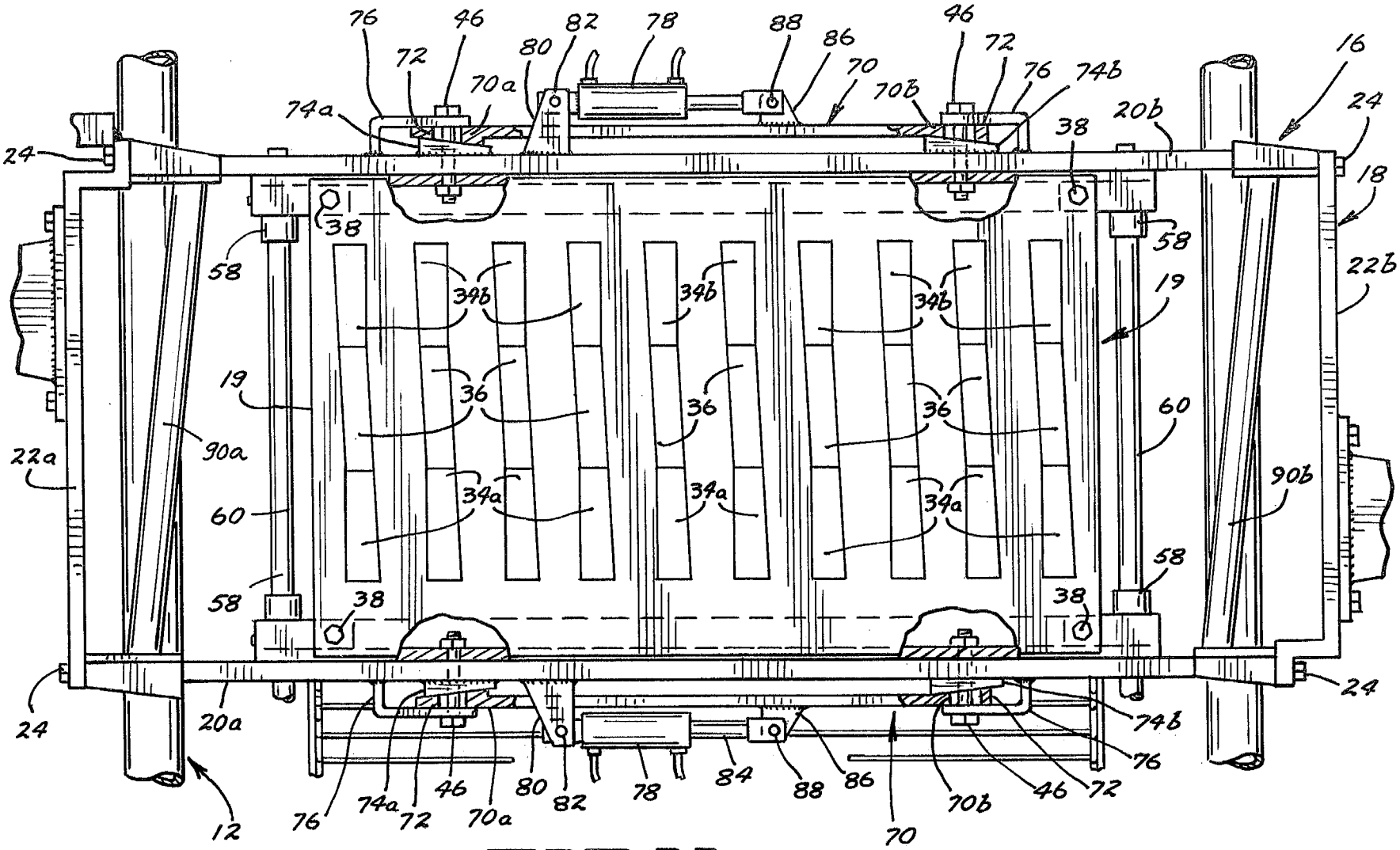
FIG. 11 is a view somewhat similar to FIG. 10, the view illustrating in its entirety the top surface of the table and also showing the clamping mechanism used to maintain the vertically adjusted position.

Also, from FIG. 11, it will be perceived that the openings 34*a* and 34*b* of each set have a strip or plate 36 extending therebetween. Having mentioned that the thickness of the blades 26 is $\frac{1}{8}$ inch, it can be stated at this time that the thickness of the pressure strips or plates 36 is $\frac{1}{4}$ inch, the regions providing the relieved pressure strips or plates 36 being milled down the same thickness as the blades 26, that is, $\frac{1}{8}$ inch. Whereas FIG. 11 is a plan view of the table 19, an effort has been made to depict the relieved or reduced thickness of the areas constituting the pressure strips or plates 36, this being done in FIGS. 9 and 13. Although not completely understandable at this stage of the description, it can be mentioned, though, that by relieving the thickness of the pressure strips or plates 36 the same amount as the thickness of the blades 26, any tendency for the fish sticks, referred to hereinafter, to curl is greatly minimized and virtually eliminated.

In order to raise and lower the table 19 with respect to the blade carrier 18, and hence with respect to the horizontal plane in which the blades 26 move, bolts 38 are employed for attaching the corners of the table 19 to the horizontal flanges of angle members 40*a*, 40*b*, the angle member 40*a* having its vertical flange movable up and down with respect to the vertical flange of the angle member 20*a*, and the vertical flange of the angle member 40*b* being similarly constrained for vertical movement with respect to the vertical flange of the angle member 20*b*. More specifically, the vertical slots 42, each of which slots 42 have extending therethrough the shank of a bolt 44, the shanks of the bolts 44 passing through drilled holes 46 in the vertical flanges of the angle members 20*a* and 20*b*. This feature, it is believed, is aptly illustrated in FIG. 9.

Also visible in FIG. 9 are inwardly directed lugs or ears 48 which are affixed to the vertical flanges of the angle members 40*a* and 40*b*. Carried by each lug or ear 48 is a pin 50, the pin 50 in each instance passing through the upper ends of a pair of links 52, there being one adjacent each face of the inwardly directed lugs or ears 48. The lower ends of the links 52 have additional pins 54 extending therethrough and also through internally threaded adjusting blocks labeled 56. The adjusting blocks 56 receive oppositely threaded end portions 58 integral with an adjusting rod 60. It should be recognized that the adjusting rod 60 is of a length so that it extends completely between the spaced adjusting blocks 56, as fairly clearly deducible from FIG. 9; however, as already mentioned, the line 9—9 of FIG. 4 along which FIG. 9 is taken is irregular so as to include a portion of the table 19, for this reason the connecting portion of the adjusting rod 60 appears in only dotted or phantom outline in FIG. 9. From FIG. 11, it can be noted that there are actually two adjusting rods 60, there being one at each end of the table 20.

The reason for having two adjusting rods 60 is so that both ends of the table 19 can be raised or lowered at the same time, thereby assuring that the table 19 remains horizontal irrespective of the elevation or height that it is adjusted to. To rotate the rods 60 in unison, there is a worm gear 62 at one end of each of the adjusting rods 60, and in mesh with each worm gear 62 is a worm 64 keyed at spaced locations to an adjusting shaft 66, as best viewed in FIGS. 3 and 6.

From FIG. 1, it can be observed that the shaft 66 has a handwheel 68 thereon by means of which the shaft 66 can be rotated to in turn rotate the adjusting rods 60 and thereby raise and lower the table 19 through the intermediary links 52.

It is believed evident from the description given above that the parts 40–68 collectively constitute a mechanism for raising and lowering the table 19. However, in order to relieve the table adjusting mechanism from having to shoulder the cutting loads, provision is made for clamping the table 19 at whatever height it is adjusted to. This is done by means of a pair of clamping slides 70, the construction of these slides 70 being perhaps best understood from FIG. 11. At the opposite ends of the clamping slides 70 are wedges 70*a* and 70*b*, each wedge 70*a* and 70*b* having a slot 72 formed therein. The vertical flange of the angle member 20*a* has a pair of wedges 74*a*, 74*b* secured thereto, and similarly the vertical flange of the angle member 20*b* has a pair of wedges 74*a* and 74*b* secured thereto. The wedges 70*a* and 74*a* coact with each other. The bolts 46 have already been mentioned; at this time it can be pointed out that they extend through the wedges 70*a*, 74*a* and 70*b*, 74*b*. L-shaped brackets 76 are welded to the vertical flanges of the angle members 20*a* and 20*b*, the bolts 46 also passing through holes near the free ends of the brackets 76.

Through the intermediary of pneumatic or hydraulic cylinders 78 the clamping slides 70 can be actuated so that the wedges 70*a*, 74*a* and 70*b*, 74*b* are cammed tightly together, thereby maintaining the table 19 at its adjusted height. A lug or ear 80 is welded to the vertical flange of each of the angles members 20*a*, 20*b* and a pin 82 connects the lug or ear 80 to the closed end of the hydraulic cylinder 78 at each side of the table. The piston rod 84 which extends from each cylinder 78 is similarly connected to a lug or ear 86 by means of a pin 88, the lugs or ears 86 being secured to the clamping slide 70 in each instance.

Hence, when the piston rod 84 is pulled inwardly by hydraulic fluid or air acting against the piston within the hydraulic cylinder 78, such action moves each clamping slide 70 to the left as viewed in FIG. 11, thereby forcing the wedges 70*a*, 70*b* tightly against the wedges 74*a*, 74*b*. Hydraulic fluid or air under pressure directed into the opposite end of each hydraulic or pneumatic cylinder 78 urges the piston rods 84 outwardly to unclamp the table 19 with respect to the angle members 20*a* and 20*b*.

It has previously been mentioned that the blades 26 are mounted on the blade carrier 18 at a 2° angle. Stated somewhat differently, the opposite ends of the blades 26 are offset with respect to each other as far as the point of attachment thereof to the angle members 20*a*, 20*b*. Not only are the blades 26 mounted at an angle, but the entire cutter assembly 16 is advanced and retracted at an acute angle which now will be described. More specifically, whereas the blades 26 are oriented at the 2° angle, the path or stroke of the entire cutter assembly 16 is at a 6° angle. This 6° angle is denoted in FIG. 19.

Describing now the manner in which the cutter assembly 16 is constrained for rectilinear movement at the 6° angle that has just been mentioned, it is to be noted that angled shafts 90*a* and 90*b* are instrumental in constraining the cutter assembly 60 for movement back and forth at the desired acute angle, which has been mentioned as being 6°. Once again, the reason for this angular movement will not be immediately apparent, although it will become so as the description progresses.

Figure 8:
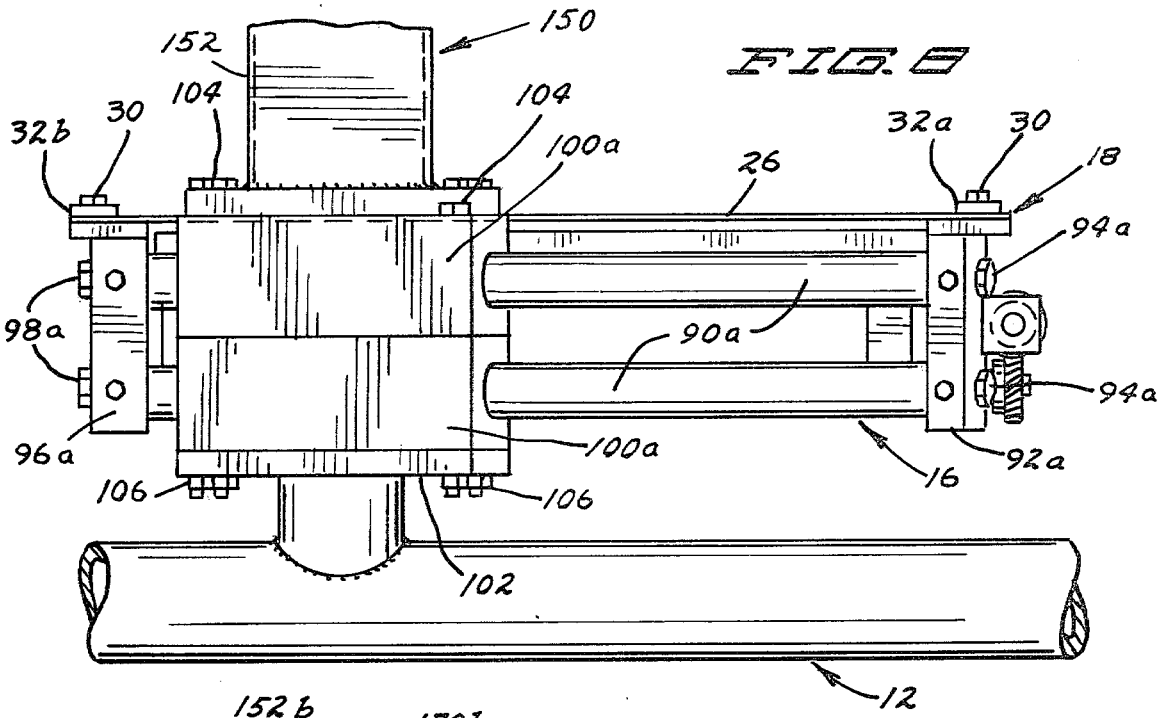
FIG. 8 is an enlarged elevational view taken in the direction of line 8—8 of FIG. 4 for the purpose of showing how the cutter assembly is slidably mounted so that the blades perform their severing action in an effective manner.

Actually, there are two shafts 90*a*, as can be seen in FIG. 8, one being vertically aligned above the other. Similarly, there are two such shafts 90*b*, there being one above the other. A mounting block 92*a* is welded to the angle member 20*a*. By means of bolts 94*a* extending through the mounting block 92*a*, one end of each shaft 90*a* is supported by the mounting block 92*a*, as can be learned from FIG. 8. In a similar manner the corresponding ends of the shafts 90*b* are attached to a block 92*b* by bolts 94*b*, this being generally understandable from FIGS. 4, 5 and 11, although not shown in the detail that is set forth in FIG. 8. FIG. 8, however, does demonstrate that the other ends of the shafts 90*a* are held in place by a block 96*a* which is welded to the angle member 20*b*, bolts 98*a* actually retaining the ends of the shafts 90*a* in a fixed relation with the angle member 20*b*. A block 96*b* similarly anchors the other ends of the shafts 90*b* via bolts 98*b*.

The point to appreciate is that both pairs of shafts 90*a* and 90*b* are mounted at the same acute angle, more specifically 6°, as far as a line extending perpendicularly to the angle members 20*a*, 20*b*. Stated somewhat differently, the shafts 90*a* and 90*b* can be said to extend at an angle of 6° relative to the brackets 22*a*, 22*b* (such as the line 238 later referred to when describing FIGS. 16 and 18). It is imperative that it be understood that the shafts 90*a* and 90*b* are an integral or fixed part of the cutter assembly 16 and more specifically the blade carrier 18. Of course, the cutter assembly 16 comprises both the blade carrier 18 and the table 19, the carrier 18 and the table 19 moving in unison at the acute angle determined by the angulation fo the shafts 90*a*, 90*b*.

Considering FIG. 8 again, it will be learned that a pair of bearing blocks 100*a* are vertically stacked and held in a fixed relationship with the frame 12. More specifically, the tubular member of the frame 12 appearing in FIG. 8 supports a mounting pad 102 through which the lower ends of bolts 104 extend, the bolts 104 having nuts 106 thereon. At this time it is only important that one appreciate that the bolts 104 fixedly anchor the bearing blocks 100*a* in a fixed relationship with the frame 12. Of course, the bearing blocks 100*a*, and also the bearing blocks 100*b*, are oriented at the aforenoted acute angle of 6° so that the cutter assembly 16 is constrained to traverse a rectilinear path at the same acute angle, the shafts 90*a* being so guided by the fixed bearing blocks 100*a*, and the shafts 90*b*at the other side being guided by the fixed bearing blocks 100*b*.

Describing now the drive mechanism for effecting the advancing and retracting of the cutter assembly 16 through the acute angle that has been selected, more specifically 6°, it will first be noted that the brackets 22*a* and 22*b* are each provided with oppositely issuing lugs or ears 110 which are secured to the brackets 22*a*, 22*b* through the agency of bolts 112. Each lug or ear 110 carries a pin 114 which in each instance pivotally connects with a crank arm 116, there being a crank pin 118 at the other end of the arm 116 in each case.

To counterbalance the mass of the cutter assembly 16 as it is reciprocated back and forth and to actuate the crank arms 110 via the crank pins 118, a pair of flywheels 120 are employed, the flywheels 120 being rotated in opposite directions as indicated by the arrows 122 and 124 appearing in FIG. 1. In other words, the flywheels 120 are rotated about vertical axes, and the crank pins 118 are offset or eccentrically located with respect to these vertical axes, these axes being provided by vertical shafts 126 journaled in bearings 128. Each shaft 126 extends downwardly to a coupling 130 and a second shaft 132 extends downwardly to a gear box 134.

Obviously, the flywheels or eccentrics 120, even though rotated in opposite directions as indicated by the arrows 122 and 124, must be rotated at the same rotational speed. Therefore, a single hydraulic motor 136 is employed having a shaft 138 extending to a coupling 140 which coupling has a shaft 142 leading to a gear box 144. Shafts 146 and 148 extend from the gear box 144 to the respective gear boxes 134. Consequently, by means of the shafts 146 and 148, each of which is rotated at the same rate, both of the shafts 126 are driven at the same rate, although in opposite rotational directions, as already explained, and which opposite directions have been visually indicated by the rotational arrows 122 and 124 in FIG. 1.

It is believed evident that owing to the eccentricity of the flywheels 120, more particularly the offset relationship between the crank pins 118 and the vertical shafts 126, the cutter assembly 16 is caused to move from one extreme position to another. In this regard, one extreme position occurs when the flywheels 120 are in the angular position pictured in FIG. 1, FIG. 4 also depicting this same extreme position. However, when the flywheels 120 have been rotated 180°, the extreme position of the cutter assembly 16 shown in FIG. 5 is realized. Whereas the back and forth motion or stroke is rectilinear, it must be borne in mind that this is achieved in an angular direction. The reason for the angularity is better reserved for subsequent elaboration.

Attention is directed at this time to a magazine 150 comprised of ten vertical tubes or chutes 152, each tube or chute having a partition 154 which divides the tube into a pair of side-by-side open-ended compartments 152*a* and 152*b*. The lower ends of the tubes or chutes 152 are anchored to a base plate 166. Thus, the base plate 166, which is horizontal, maintains the various tubes or chutes 152 in their upright or vertical position. The base plate 166 has its opposite ends attached to the upper bearing blocks 100*a* and 100*b*, three of the previously mentioned bolts 104 being employed to fasten the base plate 166 to the upper bearing block 100*a* at one side of the apparatus 10 and to the upper bearing block 100*b* at the other side of the apparatus 10. Consequently, it will be recognized that the magazine 150 is fixedly mounted and that the cutter assembly 16 moves relative thereto.

The tubes or chutes 152 of the magazine 150 are purposely spaced laterally with respect to each other. However, the partition 154 that divides each tube or chute 152 into the two above-mentioned side-by-side vertical compartments 152*a* and 152*b* is relatively thin. In this way, it can be said that the compartments 152*a* and 152*b* of one tube or chute 152 constitute a pair of such compartments and the same thing holds true for each of the other tubes or chutes 152.

Consequently, when a frozen fish slab 170*a* is inserted downwardly through the top of each compartment 152*a* of each tube or chute 152 and a corresponding frozen fish slab 170*b* is inserted downwardly through the upper end of the other compartment 152*b* of each tube or chute 152, it follows that the frozen fish slabs 170*a* and 170*b* constitute, as far as each tube or chute 152 is concerned, a pair of frozen fish slabs; the term "pair" is deemed appropriate because each two slabs 170*a* and 170*b* are closely adjacent each other, being spaced apart only a distance equal to the thickness of the partition 154. Cognizance should also be taken of the fact that the slabs 170*a* and 170*b* have a rectangular configuration when viewed from the top and this determines two of the dimensions of the ultimate fish sticks derived successively from the paired slabs 170*a* and 170*b*.

Although the manner in which the frozen fish slabs 170*a* and 170*b* are severed into individual fish sticks, which sticks have been given the reference numerals 172*a* and 172*b*, will not be fully appreciated at this stage of the description, it should be noted that there is disposed immediately subjacent the base plate 166 a so-called finger plate 174. Although the finger plate 174 is only depicted in dotted outline in FIGS. 4 and 5, it should be pointed out that the plate 174 has a number of upwardly directed threaded studs 176 that extend through a number of holes in the base plate 166. Nuts 178 on the studs 176 hold the finger plate 174 tightly against the underside of the base plate 166.

Figure 7:
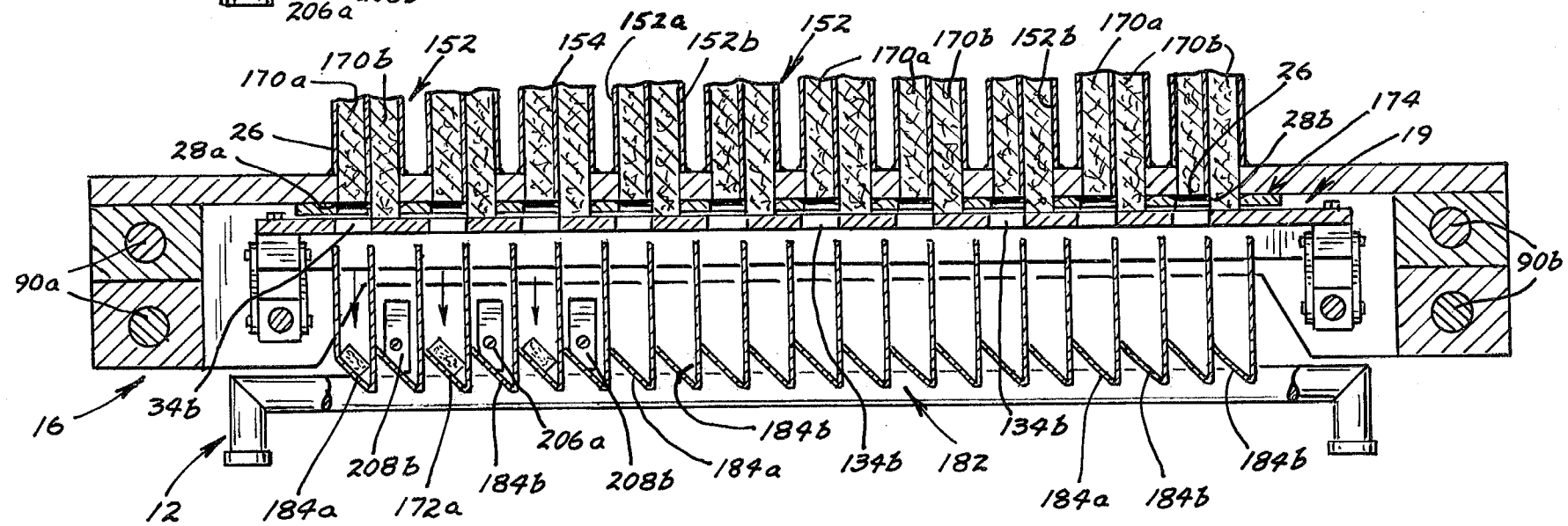
FIG. 7 is a sectional view taken in the direction of line 7—7 of FIG. 4, the view resembling somewhat what is shown in FIG. 6 but showing to better advantage the manner in which the fish sticks are cut from the lower ends of the frozen fish slabs.
Figure 10:
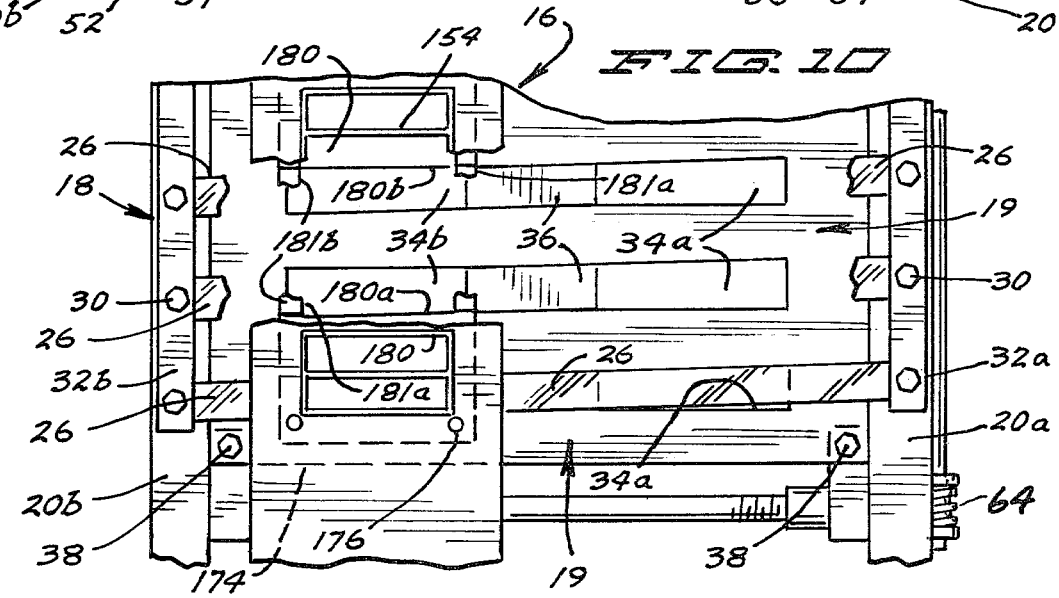
FIG. 10 is a top plan view taken in the direction of line 10—10 of FIG. 9, portions having been removed in order to expose to view a section of the table that would otherwise be concealed.
Figures 17, 20, 26, 28, 29:
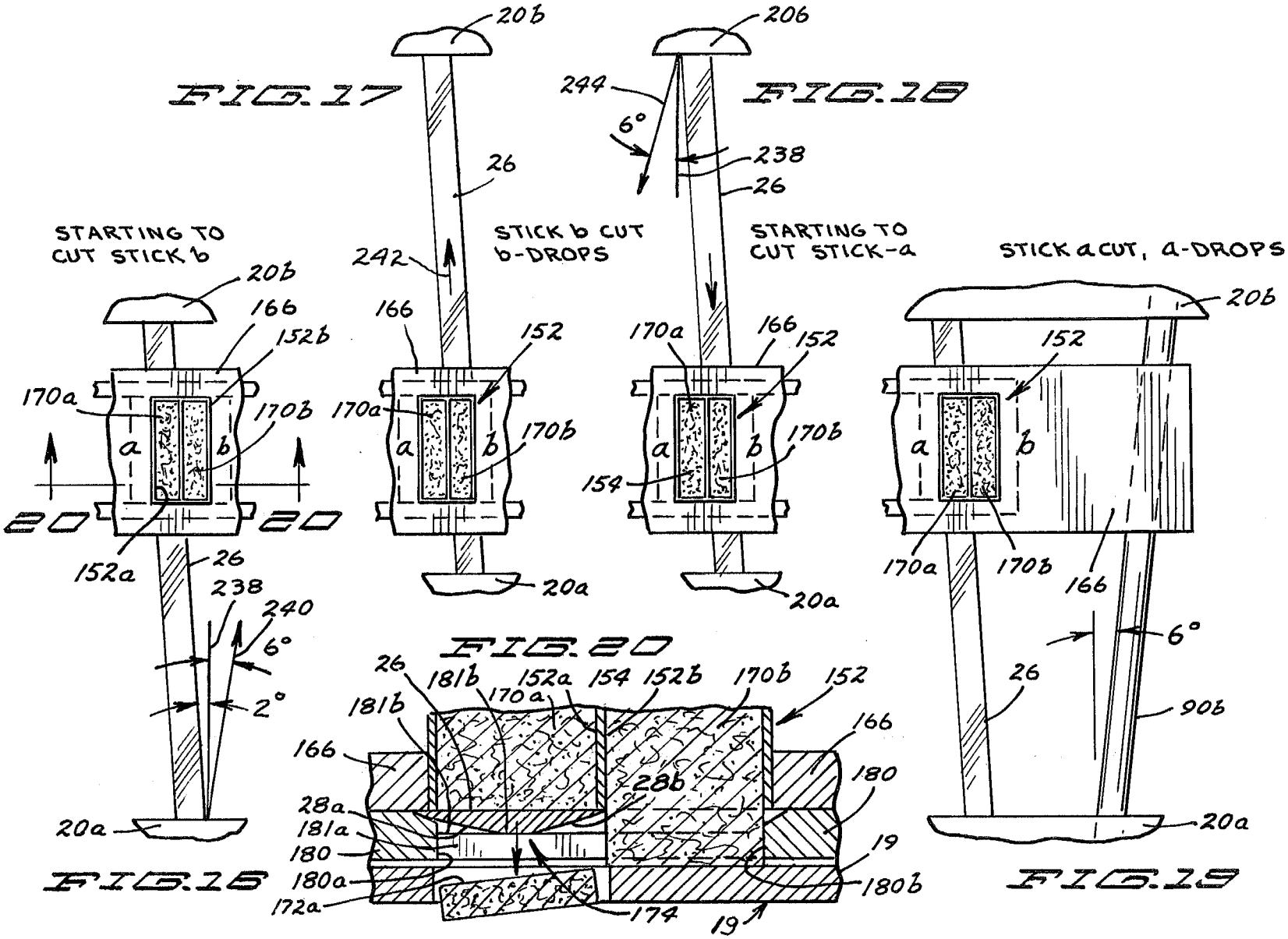

As can be seen from FIGS. 7, 10 and 20, particularly the last-mentioned figure, the finger plate 174 has a number of bridging fingers 180 which, as can be perceived from FIG. 20, form a vertical surface 180*a* at one side thereof and a vertical surface 180*b* at the other side thereof. The surfaces 180*a*, 180*b* are spaced the same distance that the sides of each tube or chute 152 are spaced so that each surface 180*a* is vertically aligned with one side of each slab 170*a* and the surface 180*b* is similarly aligned beneath the oppositely facing side of the other slab 170*b*. It will be understood that there are surfaces 180*a* and 180*b* associated with the lower end of each tube or chute 152. In this way, the surfaces 180*a* and 180*b* are capable of absorbing the lateral thrust resulting from the severing or cutting of the various fish sticks 172*a* and 172*b*, all of which will become more apparent hereinafter. However, at this point reference will be made to a vertical surface 181*a* (FIGS. 10, 20) extending transversely between each end of the surfaces 180*a*, 180*b* so as to absorb the longitudinal thrust also resulting from the severing action. The finger plate 174 is milled to a lesser thickness at 181*b* forming a horizontal surface extending outwardly from each of the vertical surfaces 181*a* so as to underlie the blade 26 and thus support the blade 26 as it moves beneath its particular tube 152. This arrangement is, of course, utilized for each blade 26, thereby preventing downwardly flexing of that portion of the blade 26 then performing a cutting operation. In other words, even though the blades 26 have an appreciable length, on the order of 22 inches, only approximately six inches of each blade 26, that is the portion actually doing the cutting at any given moment, remains unsupported. This relatively short section or portion therefore flexes only insignificantly. Stated somewhat differently, the blades 26 slide over the various laterally spaced surfaces 181*b* of reduced thickness formed in the marginal portions of the finger plate 174 at opposite sides thereof, and the blades 26 are thus supported subjacent the tubes or chutes 152 as the blades travel therebeneath.

When the various fish sticks 172*a* and 172*b* are severed from the various slabs 170*a*, 170*b*, respectively, they fall gravitationally into a collection unit 182 comprised of a number of angled troughs 184*a*, 184*b*. Stated in a somewhat different manner, there is one angled trough 184*a* beneath each compartment 152*a* and an angled trough 184*b* beneath each compartment 152*b*.

Once again, it is recognized that the cutting or severing of the various fish sticks 172*a* and 172*b* is yet to be described. However, from FIGS. 1 and 2, it can be noted that a number of fish sticks 172*a* and 172*b* have been pictured. In this regard, they are moving on a conveyor assembly denoted generally by the reference numeral 186 which comprises an endless wire mesh belt 188 entrained about spaced horizontal rollers 190.

Further included in the conveyor assembly 186 is a hydraulic motor 192 which operates independently of the motor 136 so that the wire mesh belt 188 can be driven at any preferred speed, depending upon the rate at which the fish sticks 172*a* and 172*b* are produced and the end-to-end spacing thereof that is desired. The hydraulic motor 192 has a drive shaft 194 to which is keyed a drive pulley 196. Passing about the drive pulley 196 is a flexible belt 198 which also passes about a driven pulley 200 on the roller 190 at the right in FIG. 2.

Having mentioned the various angled troughs 184*a*, 184*b* constituting the collection unit 182 for the various fish sticks 172*a* and 172*b* falling from the lower ends of the slabs 170*a*, 170*b*, it should now be manifest that the upper stretch of the wire mesh belt 188 is substantially at the same elevation as the angled troughs 184*a*, 184*b*. However, the various fish sticks 172*a* and 172*b*, after they have fallen into the collection unit 182 and rest respectively in the angled troughs 184*a*, 184*b*, must be shifted or transferred from the collection unit 182 onto the wire mesh belt 188 of the conveyor assembly 186.

Figure 12:
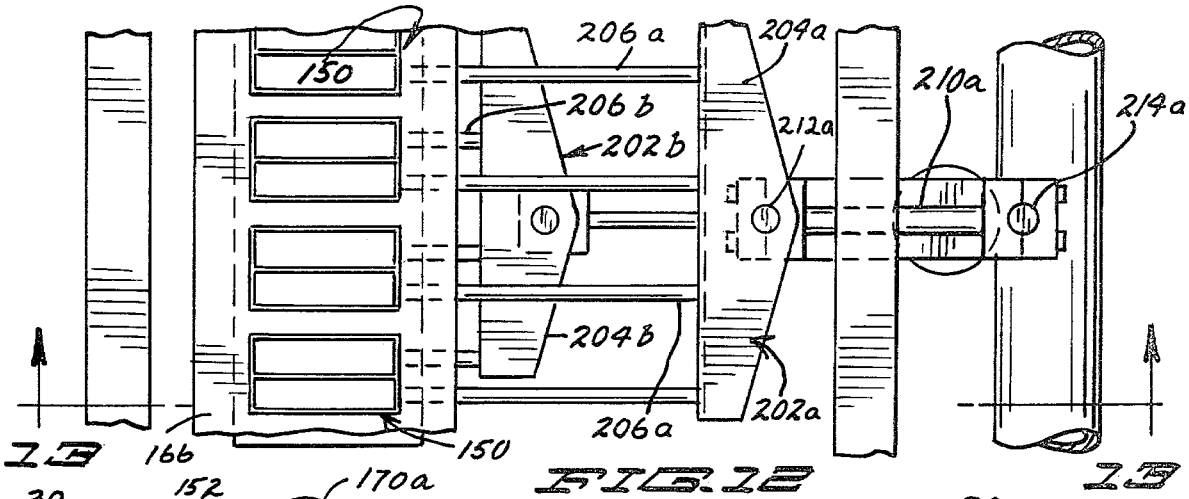
FIG. 12 is an enlarged fragmentary view corresponding to a portion of FIG. 1, the purpose of the view being to illustrate more clearly the manner in which the fish stick pushers are actuated.
Figure 14C:
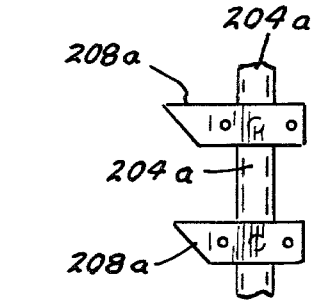
FIGS. 14A, 14B and 14C are detail views of two of the upper pushers, FIG. 14A being a top plan view, FIG. 14B being a side elevational view, and FIG. 14C being an end view.
Figure 14A:
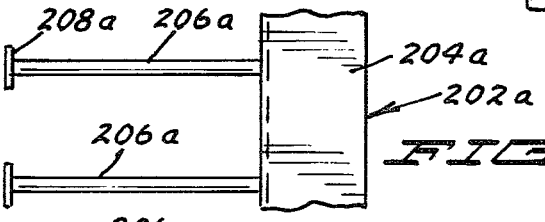
Figure 14B:
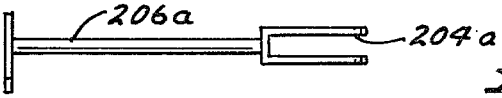

To achieve the transfer of the fish sticks 172*a*, 172*b* onto the wire mesh belt 188 of the conveyor assembly 186, upper and lower pusher units 202*a*, 202*b* are employed. Clustered FIGS. 14A, 14B and 14C detail the construction of the upper pusher unit 202*a*. However, the construction of the pusher unit 202*a* can also be understood from FIGS. 12 and 13. Thus, the unit 202*a* includes a channel-shaped cross beam 204*a* having a number of rods 206*a* projecting therefrom, there being one such rod 206*a* for each angled trough 184*a*. At the free or distal end of each rod 206*a* is a shoe 208*a*. As can be noted from FIG. 14C, the lower ends of the shoes 208*a* are pointed or angled so as to correspond with the angled configuration of the troughs 184*a*.

Figure 15A:
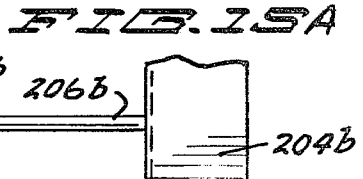
FIGS. 15A, 15B and 15C are views corresponding to FIGS. 14A, 14B and 14C, respectively, but showing lower pushers.
Figure 15C:
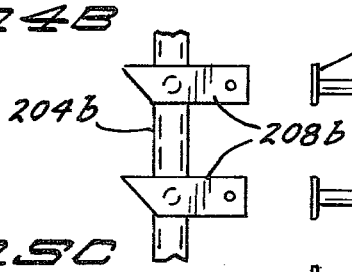
Figure 15B:
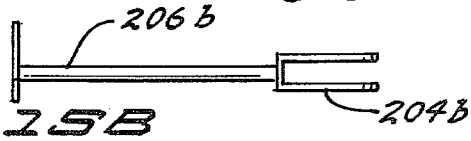

Before referring to the manner in which the pusher units 202*a* and 202*b* are actuated in an out-of-phase relationship, it will be well to allude to the similar construction of the unit 202*b*. This is pictured in the clustered FIGS. 15A, 15B and 15C, the channel-shaped cross beam 204*b* corresponding to the beam 204*a* and the various rods 206*b* to the rods 206*a*, as well as the shoes 208*b* with respect to the shoes 208*a*. The real difference is that the shoes 208*b* ride in the angled troughs 184*b* in contradistinction to the troughs 184*a* in which the shoes 208*a* ride.

As stated above, the pusher units 202*a* and 202*b* are actuated in an out-of-phase relationship. Nonetheless, the out-of-phase relationship is synchronized with the reciprocal movement of the cutter assembly 16. Therefore, the same hydraulic motor 136 that is instrumental in advancing and retracting the cutter assembly 16 in an angular direction determined by the angulation of the shafts 90*a*, 90*b*, and of course the bearing blocks 100*a* and 100*b* guided thereby, is used for actuating both the upper pusher unit 202*a* and the lower pusher unit 202*b*.

The actuation of the pusher units 202*a*, 202*b* is derived via a drive mechanism now to be referred to. It has already been mentioned that the cross beams 204*a*, 204*b* are channel-shaped. From FIG. 13 it will be seen that one end of a crank arm 210*a* is received in the channel of the upper cross beam 204*a*, there being a pin 212*a* effecting the requisite connection, and that a crank arm 210*b* is similarly connected to the lower cross beam 204*b* by a pin 212*b*. The other ends of the crank arms 210*a* and 210*b* are connected by pins 214*a*, 214*b* to an eccentric 216, the pin 214*a* being connected to the eccentric 216 indirectly by means of a link 218. As the eccentric 216 rotates, the pin 214*a* is moved forwardly or to the left in FIG. 13, whereas a reverse movement occurs with respect to the pin 214*b*. Hence, as the upper unit 202*a* is moved to the left as viewed in FIGS. 12 and 13, the lower unit 202*b* is pulled to the right.

Continuing the description of the manner in which the pusher units 202*a* and 202*b* are actuated, it is to be noted that the eccentric 216 is carried at the upper end of a vertical shaft 220*a* which extends downwardly to a gear housing 222, the lower end of the shaft 220*a* having a first bevel gear 224*a* keyed thereto which is in mesh with a second bevel gear 226*a* keyed to a horizontal shaft 228. The shaft 228 has another bevel gear 226*b* in mesh with a bevel gear 224*a* at the lower end of another vertical shaft 220*b*. The upper end of the vertical shaft 220*b* has another eccentric 216 which actuates the other ends of the cross beams 204*a*, 204*b* with parts identical to those just referred to and which have been given identical reference numerals where visible in FIGS. 1 and 3.

The horizontal shaft 228 extends to a gear box 230, the shaft 228 having a bevel gear 232 thereon which is in mesh with a second bevel gear 234 within the gear box 230. The bevel gear 234 is keyed to one end of another horizontal shaft 236 coupled at its other end to previously mentioned shaft 146 via the gear box 134 with which the shaft 146 connects. In this way, the pusher units 202*a* and 202*b* are driven by the same hydraulic motor 136 as is the cutter assembly 16. However, it is believed apparent from the preceding description that the pusher units 202*a*, 202*b* are moved in opposite directions. The reason for this will be made even clearer during the ensuing operational description.

Operation

Having presented a description of the various components and their organization with respect to each other as far as our exemplary apparatus 10 is concerned, a detailed operational description of such components could be given at this time. However, it is felt that a more detailed operational sequence should be deferred in favor of a more diagrammatic operational description. As a matter of fact, FIGS. 16–20 have been prepared with the thought in mind that a brief consideration of these diagrammatic views will pave the way for a more complete understanding of the detailed operation hereinafter given.

Accordingly, attention is now directed to FIG. 11. Although the severed fish sticks have been earlier identified by the reference numerals 172*a* and 172*b*, it will be somewhat simpler to refer to the two fish sticks produced by way of FIGS. 16–20 as simply "a" and "b". It is essential, though, to describe some of the basic components and since these components find a clear basis in FIGS. 1–15, it will be well to utilize the same reference numerals in referring to the basic parts. Therefore, it will be observed that a blade 26 appears and that it is movable beneath a tube or chute 152 containing therein frozen fish slabs 170*a*, 170*b*. Although previously explained, it is obvious that the slabs 170*a*, 170*b* have a rectangular cross section and this rectangular cross section determines the length and width of the resulting fish sticks 172*a*, 172*b*; however, as far as the simplified operation is concerned, the fish sticks will simply be referred to by the letters "a" and "b", as just mentioned.

The blade 26, it will be recalled, is mounted on what has been termed a blade carrier 18 which includes the two angle members 20*a*, 20*b*. Therefore, it will be helpful to identify the fragmentarily depicted portions of the angle members 20*a*, 20*b*. It will be of further assistance to apply a line 238, this line having hereinbefore been preliminarily mentioned, which extends perpendicularly with respect to the angle members 20*a*, 20*b*. Hence, it will be recognized that the 2° designation appearing in FIG. 16 indicates the angle at which the blade 26 is mounted on the carrier 18, that is, the acute angle of 2° measured with respect to the perpendicular line 238.

It will do no harm to re-emphasize the fact that the shafts 90*a*, 90*b* and the bearing blocks 100*a*, 100*b*, which have been previously described, are disposed at an angle of 6°. Therefore, such an angle has been superimposed upon FIG. 16, the arrow 240 extending at an angle of 6° with respect to the perpendicular line 238.

Consequently, when the blade 26 is moved beneath the tube or chute 152 from the position in which it appears in FIG. 16 to that in which it is shown in FIG. 17, the initial movement of the blade 26 in FIG. 16 strikes the lower lefthand corner of the frozen fish slab 170*b* as viewed in FIG. 16. It is important to understand that the blade 26, more specifically its beveled knife edge 28*b*, does not engage the flat side of the slab 170*b* in a parallel relationship. By entering the lower portion of the slab 170*b* at one corner, as just described, the impact of the initial cutting stroke is considerably lessened. Consequently, the blade 26 performs a slicing action through the entire lower end of the slab 170*b* by the time that the blade 26 reaches the position depicted in FIG. 17.

Inasmuch as FIG. 20 is a sectional view taken in the direction of line 20—20 of FIG. 16, it can be seen that the frozen slab 170*a* is at this time resting on the upper side of the blade 26, whereas the slab 170*b* is resting on the table 19. Hence, as the blade 26 moves in a horizontal plane from the position shown in FIG. 16 to that appearing in FIG. 17, it cuts or severs from the lower end of the slab 170*b* a fish stick b having a thickness corresponding to the distance that the table 19 is below the level of the blade 26.

Although an arrow 242 has been superimposed on FIG. 17, it should be appreciated that this arrow 242 represents a blade movement just prior to reaching the end of the blade stroke represented in FIG. 17. Thus, when the blade 26 reaches the position shown in FIG. 17, then the fish stick b has been completely severed from the lower end of the slab 170*b* and the new lower end of the slab 170*b* then gravitationally rests on the upper side of the blade 26.

Even though the blade 26 is repeatedly advanced and retracted, the foregoing explanation has dealt only with the advancement of the blade 26 from the position of FIG. 16 to that of FIG. 17. The retraction of the blade 26 starts with FIG. 18, which is substantially the same as FIG. 17 but it will be noted that arrow 244 has been superimposed on this figure which points in just the opposite direction from the arrow 240 of FIG. 16. Consequently, the movement of the blade 26 on its reverse or retraction stroke, that is, in the direction of the arrow 244, engages the upper righthand corner of the frozen slab 170*a*, as viewed in FIG. 18. Once again, it should be appreciated that the blade 26 does not strike the lower end of the slab 170*a* in a broadside fashion. In other words, the slab 170*a* is progressively cut as the blade 26 is retracted along its angled path.

Turning to FIG. 19, it can be understood that this figure represents the blade 26 after it has completed a full retractive stroke from FIG. 18 to FIG. 19. Thus, the fish stick a has been completely severed and has dropped down away from the newly formed lower end of the slab 170*a*. Because of this, the slab 170*a* again rests on top of the blade 26 in the same manner as it did in FIG. 16.

Recapitulating somewhat, when the blade 26 reaches the extreme position depicted in FIG. 17, then the slab 170*a* gravitationally drops onto the table 19. This presents a projected end portion which is severed by the blade 26 as it moves from the location shown in FIG. 18 to that illustrated in FIG. 19. The slab 170*b* in FIG. 19 then gravitationally rests on the table 19.

Thus, there is a repeated severing of fish sticks a and b as can be understood from FIGS. 16–20, the severing action being in an alternate manner. In other words, one fish stick b is severed when the blade 26 moves from the position in FIG. 16 to the position in FIG. 17, and a fish stick a is severed when the blade moves from FIG. 18 to FIG. 19. As the blade 26 again moves from FIG. 16 to FIG. 17, a second fish stick b is severed, and when the blade moves back from FIG. 18 to FIG. 19, another fish stick a is severed.

It should be recognized from FIG. 20 that the vertical surfaces 180*a* and 180*b*, these being surfaces provided by the bridging fingers 180 on the finger plate 174, absorb the lateral forces produced during the cutting or severing action. In this regard, it can be appreciated from FIG. 20 that as the blade 26 starts to move, its knife edge 28*b* enters the slab 170*b* and forces the lower end of the slab 170*b* against the surface 180*b*. When the blade moves in a reverse direction, that is from FIG. 18 to FIG. 19, then the knife edge 28*a* forces the lower end of the frozen slab 170*a* against the surface 180*a* as the fish stick a is cut. Longitudinal cutting forces are absorbed by the transverse vertical surfaces 181*a*, there being such a surface 181*a* extending transversely between the surfaces 180*a* and 180*b* at each end thereof.

From FIG. 20, it is believed evident that the horizontal surfaces 181*b*, there being one such horizontal surface 181*b* extending in a longitudinal direction forwardly and rearwardly from each vertical surface 181*a*, slidingly support the blade 26 so that it does not flex or bow downwardly when severing fish sticks a and b. This holds true for the other blades 26 as well.

In order to provide an even more complete understanding of how our apparatus 10 operates, it can be pointed out that as far as the depicted equipment is concerned, the user would cut 20 slabs of frozen fish or the like having a cross section which determines the length and width of the desired fish sticks 172*a*, 172*b*. It has previously been mentioned that fish sticks typically have a length of $3\frac{7}{8}$ inches and a width of $\frac{7}{8}$ inch. Of course, the tubes or chutes 152 are dimensioned so as to slidably receive the slabs 170*a*, 170*b* in the respective open-ended compartments 152*a*, 152*b* formed by the partition 154 which divides the interior of each tube 152 into the two side-by-side vertical compartments 152*a*, 152*b*.

Figure 4:
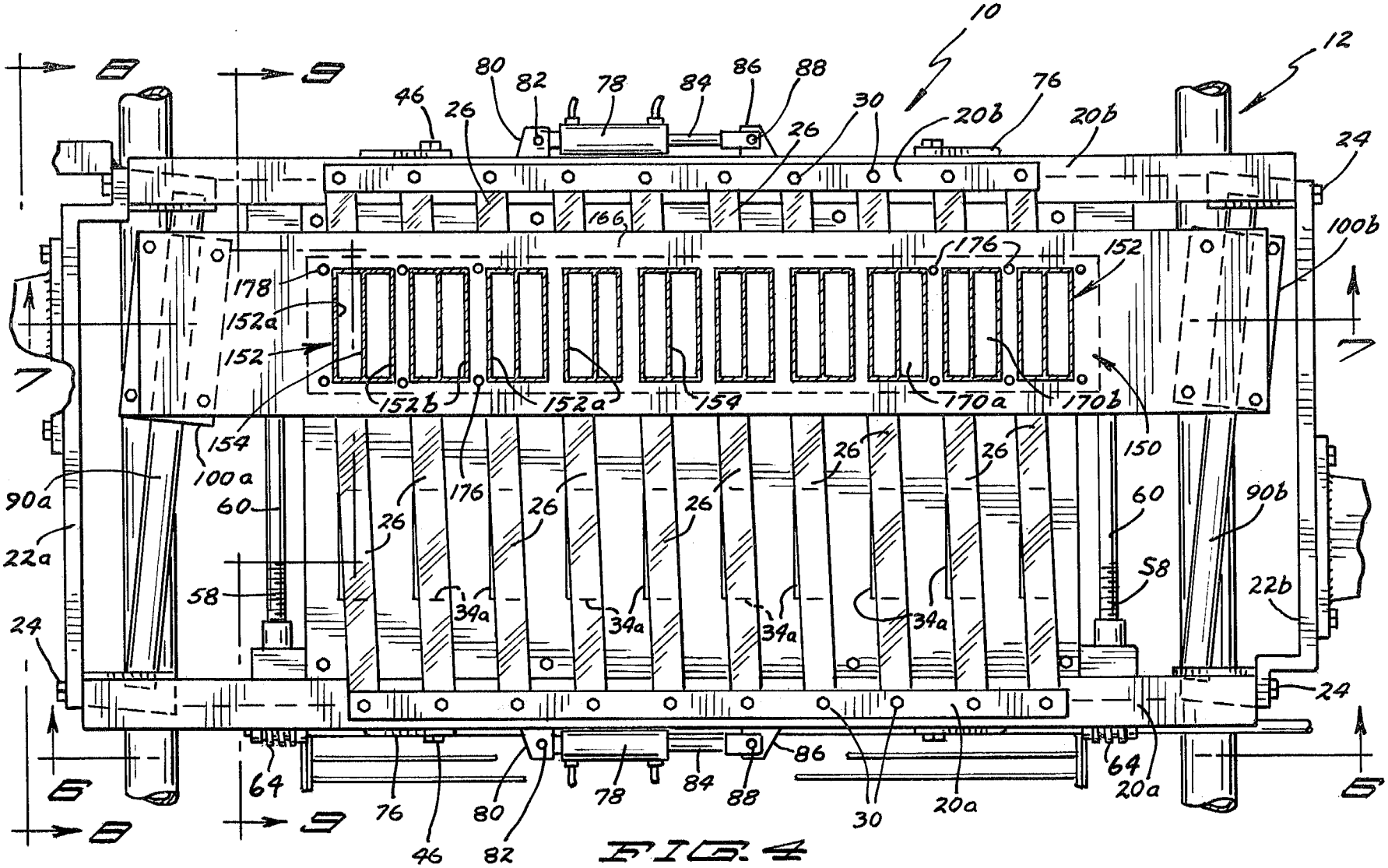
FIG. 4 is an enlarged top plan view of the cutter assembly at one end of its stroke, the view being taken in the direction of line 4—4 of FIG. 2.
Figure 5:
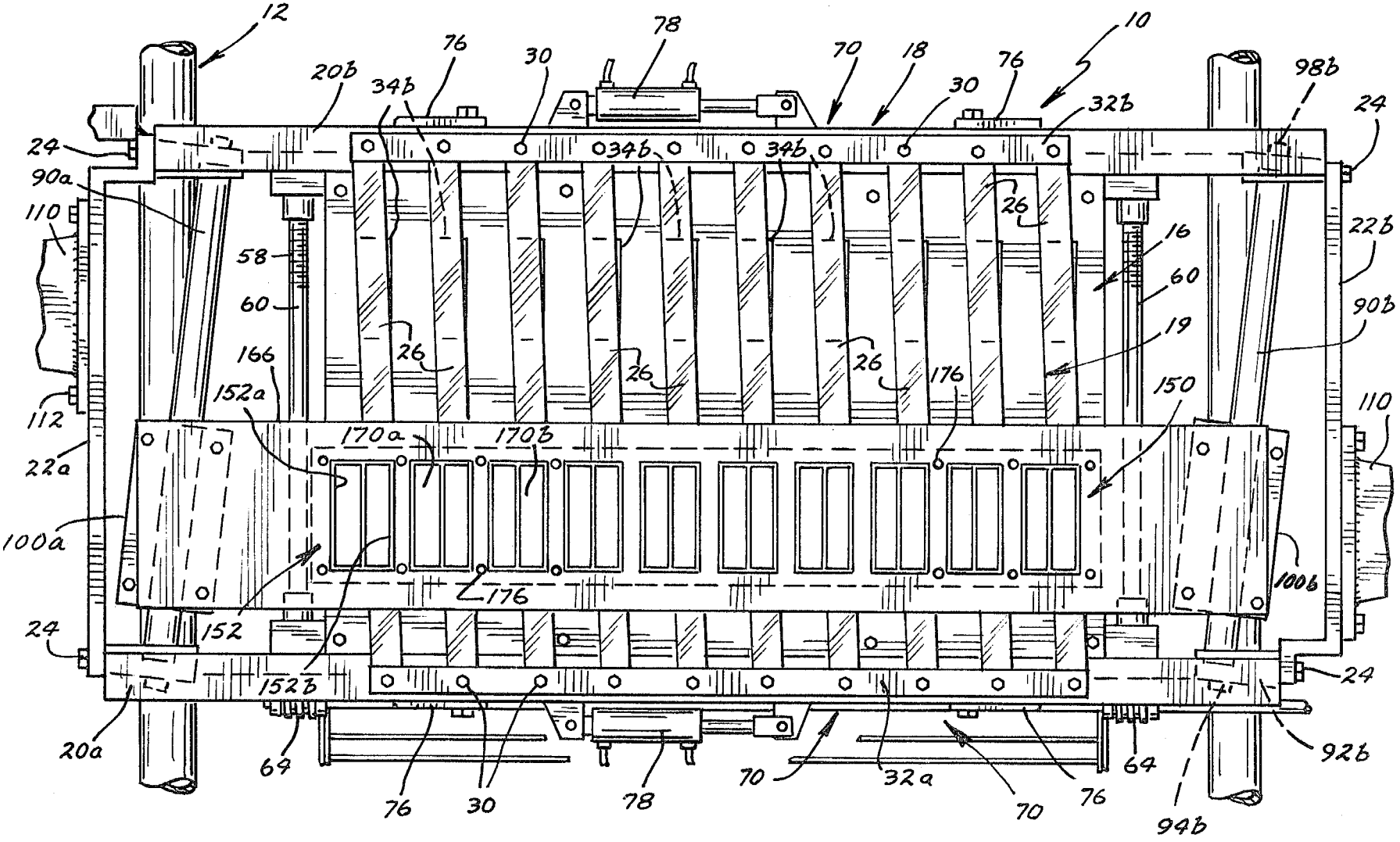
FIG. 5 is a top plan view of the cutter assembly at the other end of its stroke.
Figure 5:
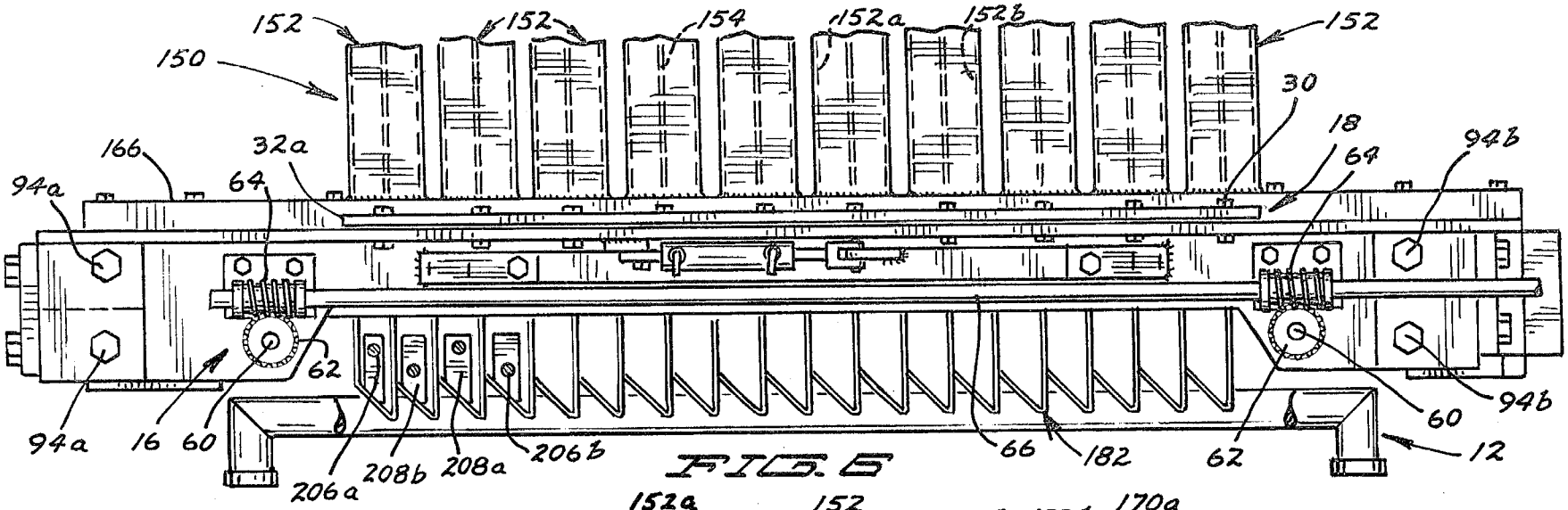

Assuming that the cutter assembly 16 is to the right as seen in FIG. 1, this being the same extreme position illustrated in FIG. 4, then the slabs 170*a*, and there are ten such slabs 170*a*, have their lower ends gravitationally supported on the upper surfaces of the ten blades 26. Under these circumstances, the other ten slabs 170*b* are supported directly on the table 19. FIG. 7 shows the various slabs 170*a* resting on the blades 26 and also shows the slabs 170*b* resting on the table 19.

For the sake of discussion, it will be presumed that the table 19 has been adjusted to the desired elevation so as to produce fish sticks 172*a*, 172*b* having the desired thickness, which has already been mentioned as being typically 7/32 inch. Of course, thicker fish sticks are frequently cut, being on the order of $\frac{1}{2}$ inch. However, if any other thickness is desired, which incidentally can be achieved while the apparatus 10 is operating, all that need be done is to rotate the handwheel 68. Rotation of the handwheel 68 is instrumental in rotating the adjustment rod 60; inasmuch as the threaded sections 58 are oppositely pitched, it follows that the links 52 are rocked to either raise or lower the table 19.

If the height of the table 19 is to be modified or changed from one elevation to the other, it also must be recognized that the hydraulic or pneumatic cylinders 78 must be operated so as to shift the clamping slides 70 in a direction to release the camming action that normally maintains the table 19 in a locked condition as far as its elevation is concerned. Movement of the wedges 70*a*, 70*b* to the right as viewed in FIG. 11 removes the camming pressure that normally is applied between these wedges and the wedges 74*a*, 74*b*. It is when the table 19 is unclamped that the handwheel 68 is used to adjust the elevation of the table to whatever height is desired. It has already been made manifest that the height of the table 19, that is the distance beneath the horizontal plane in which the blades 26 move, determines the thickness of the resulting fish sticks 172*a*, 172*b*.

Assuming that the various frozen slabs 170*a*, 170*b* have been inserted downwardly into the open-ended compartments 152*a*, 152*b*, it should be evident that the slabs 170*a*, 170*b* contained in each tube or chute 152 constitute a pair of such slabs and that the two slabs 170*a*, 170*b* of each pair of such slabs is closely adjacent to each other by reason of the fact that the partition 154 is relatively thin. On the other hand, the lateral spacing between the individual tubes or chutes 152 is much greater and it is believed that the greater distance, which can be perceived from FIGS. 1, 4 and 5, accents the pairing of each two slabs 170*a*, 170*b*.

With the apparatus 10 ready for operation as described above, the hydraulic motor 136 is then started. The hydraulic motor 136 performs two basic driving functions, only one of which will be described in detail at this particular moment. In this regard, it will be recognized that the hydraulic motor 136 causes the flywheels 120 to be rotated in the direction of the arrows 122, 124, as can be seen in FIG. 1. Since the angular position of the flywheels 120 in FIG. 1 is such as to cause the cutter assembly 16 to be moved as far to the right in FIG. 1 as possible, that is at one end of the cutting stroke, it follows that rotation of the flywheels 120 will then cause the crank arms 116 to moved toward the left in FIG. 1. This has the same effect as moving the cutter assembly 16 from the position in which it resides in FIG. 4 to that in which it resides in FIG. 5. Actually, FIG. 4 corresponds to FIG. 1, as far as one extreme position of the cutter assembly 16 is concerned.

The movement from FIG. 4 to FIG. 5 will be considered to be an advancement of the cutter assembly 16. Inasmuch as the cutter assembly 16 comprises the blade carrier 18 and also the table 19, both of these units 18 and 19 move from the position of FIG. 4 to the position of FIG. 5. In traversing this path, ten fish sticks 172*b* are cut from the lower ends of the ten frozen fish slabs 170*b*. Not only are the various blades 26 mounted at an acute angle with respect to a perpendicular line extending between the angle members 20*a*, 20*b* (the line 238 in FIGS. 16 and 18) but the blade carrier 18 and the table 19 constituting the cutter assembly 16 are constrained to follow the angular path determined by the acute angle at which the bearing blocks 100*a*, 100*b* are arranged, the shafts 90*a*, 90*b* being slidable within said bearing blocks 100*a*, 100*b*. Consequently, the ten fish sticks 172*b* that are severed during the advancing stroke are cut by each blade 26 engaging one corner of each slab 170*b*.

When the ten blades 26 have completed their advancing stroke, that is have moved from FIG. 4 to FIG. 5, then the detached fish sticks 172*b* fall gravitationally downwardly through the holes or openings 34*a* in the table 19. Once again, it must be remembered that the table 19 moves in unison with the blades 26, the carrier 18 and the table 19 together constituting the cutter assembly 16.

As the severing of the fish sticks 172*b* progresses, that is, when the cutter assembly 16 is moved from the position thereof shown in FIG. 4 to that depicted in FIG. 5, it can be appreciated that the relieved pressure plate or strip 36 between each hole or opening 34*a* and 34*b* permits the fish stick as it is being cut to move downwardly into the relieved portion formed by the recessed plate or strip 36. Each plate or strip 36, it is to be noted, is recessed to the same degree as the thickness of the various blades 26. Hence, during the severing action, the fish sticks 172*b* are neither crushed nor curled.

Also, as the blades 26 are forced through the lower ends of the various slabs 170*b*, the forces produced as a result of the lateral cutting thrust are absorbed by the various bridging fingers 180 integral with the finger plate 174, more specifically the surfaces 180*a*, 180*b*. It will be borne in mind that the finger plate 174 is attached to the underside of the base plate 166 and hence is stationary with respect to the cutter assembly 16 and in turn stationary with respect to the ten blades 26 mounted on the carrier 18. The longitudinal cutting thrust is absorbed by the vertical surface 181*a* extending between the surfaces 180*a*, 180*b* at each end thereof.

It will once again be mentioned that any tendency for the blades 26 to flex or bend downwardly as they effect their cuts is resisted by the horizontal surfaces 181*b* on which the blades 26 slide. It will be recalled that the surfaces 181*b*, or they might be termed lands or plateaus, are formed on the plate 174 by thinning or milling down these areas by an amount equal to the thickness of the blades 26.

When the severed fish sticks 172*b* drop through the openings 34*a* in the table 19, they continue their downward descent into the collection unit 182, more specifically the ten troughs 184*b*. Since FIG. 7 is a directional view taken in the direction of line 7—7 of FIG. 4, the troughs 184*b* have not been shown with fish sticks 172*b* therein. In other words, it will be assumed that those fish sticks 172*b* that have resulted from a previous cutting operation have already been shoved from the troughs 184*b* onto the conveyer assembly 186, that is, the mesh belt 188.

When the cutter assembly 16 is moved from FIG. 5 back to the position in which it is shown in FIG. 4, then a group of ten fish sticks 172*a* are severed from the lower ends of the frozen slabs 170*a*, dropping into the troughs 184*a* through the table openings 34*b*. Fish sticks 172*a* have been pictured in FIG. 7, residing in the troughs labeled 184*a*.

The various fish sticks 172*a*, 172*b* are pushed from the collection unit 182 immediately after they are produced. The pusher units 202*a*, 202*b* have been assigned this function and it will be recalled that it has previously been stated that the pusher units are operated from the same hydraulic motor 136 as the cutter assembly 16 is operated from. Therefore, when the cutter assembly 16 is moved from the position in which it appears in FIG. 4 to that shown in FIG. 5, the pusher unit 202*a* is acted in the same direction to push any of the fish sticks 172*a* from the troughs 184*a* onto the belt 188 belonging to the conveyer assembly 186. On the other hand, when the cutter assembly 16 is retracted, then the other pusher unit 202*b* is moved in the direction of the conveyer assembly 186 to dislodge those fish sticks 172*b* residing in the angled troughs 184*b*. Of course, it is the shoes 208*a*, 208*b* of the pusher units 202*a*, 202*b*, respectively that actually engage in a successive manner the fish sticks 172*a*, 172*b* in the troughs 184*a*, 184*b*.

From FIG. 1, it should be readily apparent that the various fish sticks 172*a*, 172*b* are spaced longitudinally on the belt 188 and are also staggered or offset laterally with respect to each other. Of course, the lengthwise orientation of the various fish sticks 172*a*, 172*b* on the belt 188 is derived from the fact that they are severed lengthwise and reside in the collection unit 182 in a lengthwise fashion, the lengthwise orientation being preserved as the pusher units 202*a*, 202*b* shift the severed fish sticks onto the conveyer belt 188. The offsetting or staggered relationship existing with respect to one row of fish sticks 172*a* with respect to the next row of fish sticks 172*b* is simply derived from the lateral spacing of the angle troughs 184*a*, 184*b* constituting the collection unit 182. Of course, initially, the lateral spacing or offsetting is provided by the spacing of the various tubes or chutes 152 and the pairing of the open-ended compartments 152*a*, 152*b* which in turn arranges the fish slabs 170*a*, 170*b* in individual pairs, more specifically ten pairs.

The orientation and spacing of the fish sticks 172*a*, 172*b* as pictured in FIG. 1 is highly desirable, for such an arrangement enables the various fish sticks to be efficiently breaded and battered. Thus, as the conveyer assembly 186 moves the fish sticks 172*a*, 172*b* to the left as viewed in FIG. 1, they are moved from what can be termed a cutting or severing station beneath the magazine 150 to a processing station at the left or discharge end of the conveyer assembly 186. It will also be appreciated that the spacing between succeeding rows of fish sticks 172*a*, 172*b* can be determined by the speed at which the belt 188 is driven. It will be recalled that a separate hydraulic motor 192 is responsible for driving the mesh belt 188. By slowing down the speed of the motor 192, the rows of fish sticks 172*a*, 172*b* are closer together than when the motor is operated at a faster speed. Also, it will be recognized that the speed of the hydraulic motor 136 determines the rate at which the fish sticks 172*a*, 172*b* are severed. The cutting and conveying rates obtainable by operating the motors 136 and 192, respectively, at appropriate independent speeds is a distinct advantage in being able to correlate the overall production of fish sticks when practicing our invention.

We claim:

1. A method of severing frozen slabs of fish or the like into individual sticks comprising the steps of arranging a pair of said slabs in a generally parallel relation, cutting in one direction and in one plane a first stick from the end of one of said slabs, providing a substantially rigid surface in a second plane parallel to and spaced from said one plane, abutting one end of the other of said slabs against said rigid surface, and then cutting in said one plane and in a second direction substantially opposite to said first direction a second stick from the other of said slabs, whereby said second stick has a thickness determined by the distance between said planes.

2. The method of claim 1 including the additional steps of abutting one end of said one slab against said rigid surface, cutting in said one direction and in said one plane a third stick from the end of said one slab, again abutting one end of the other of said slabs against said rigid surface and then cutting in said one plane and in said second direction a fourth stick from the other of said slabs, whereby said third and fourth sticks also have a thickness determined by the distance between said planes.

3. The method of claim 1 in which said one plane is perpendicular to the longitudinal axes of said slabs.

4. The method of claim 3 in which said first direction is in a rectilinear path and said second direction is in a reverse rectilinear path.

5. The method of claim 4 in which said slabs are vertical and said cutting steps are performed with a blade having spaced, parallel knife edges residing in said plane.

6. The method of claim 1 in which said slabs have parallel sides facing each other and said one direction is at an acute angle with respect to the side of said one slab and said section direction is at an acute angle with respect to the side of said other slab.

7. The method of claim 6 in which said slabs have a generally rectangular cross section, said acute angle being such as to cause the cutting step in said one direction to be initiated at a corner of said one slab and to cause the cutting step in said second direction to be initiated at a corner of said other slab.

8. The method of claim 7 in which said cutting steps are performed with a double-edge blade, said cutting step in said one direction being effected by one edge of said blade when said blade is moved in said one direction and said cutting step in said second direction being effected by the other edge of said blade when said blade is moved in said second direction.

9. The method of claim 8, in which said acute angles are equal, said edges being parallel to each other and arranged at said acute angles.

10. A method of severing a number of frozen slabs of fish or the like having a rectangular cross section into a plurality of sticks comprising the steps of vertically arranging said slabs in laterally spaced pairs, simultaneously and gravitationally projecting one correspondingly positioned slab of each pair a distance beyond a horizontal plane equal to the desired thickness of the sticks to be cut, simultaneously cutting in said horizontal plane in one angular direction a stick from the lower projected end of said one correspondingly positioned slabs, simultaneously and gravitationally projecting the other correspondingly positioned slab of each pair a distance beyond said plane also equal to the desired thickness of the sticks to be cut, and simultaneously cutting in a reverse angular direction a stick from the lower projected end of the other correspondingly positioned slabs.

11. The method of claim 10 including successive projecting and cutting steps, the successive projecting steps of said one correspondingly positioned slabs alternating with the successive projecting steps of said other correspondingly positioned slabs, the successive cutting steps of said other correspondingly positioned slabs alternating with the successive cutting steps of said other correpondingly positioned slabs, and said successive projecting and cutting steps alternating with each other.

12. A method of severing frozen slabs of fish or the like into individual sticks comprising the steps of vertically arranging a pair of said slabs in a generally parallel relation, projecting one of said slabs a distance beyond a plane perpendicular to the longitudinal axes of said slabs which distance corresponds to the thickness that is desired for a first stick, cutting in a rectilinear path in one direction said first stick from the projected end of said one slab, projecting said other slab a distance beyond said plane which distance corresponds to the thickness that is desired for a second stick, and then cutting in a reverse rectilinear path in a second direction substantially opposite to said first direction said second stick from the other of said slabs, said cutting steps being performed with a blade having spaced, parallel knife edges residing in said plane and the lower end of said other slab resting on the upper side of said blade while said first stick is being cut and in which the resulting lower end of said one slab rests on the upper side of said blade while said second stick is being cut.

13. A method of severing frozen slabs of fish or the like having parallel sides and a generally rectangular cross section into individual sticks comprising the steps of vertically arranging a pair of said slabs in a generally parallel relation with one parallel side of each slab facing each other, gravitationally projecting one of said slabs, cutting in a horizontal plane in one direction and at an acute angle with respect to the said one side of said one slab a first stick from the end of said one slab, said cutting step in said one direction being initiated at a corner of said one slab, gravitationally projecting the other of said slabs and then cutting in said horizontal plane in a second direction substantially opposite to said one direction at an acute angle with respect to the said one side of said other slab a second stick from said other slab, said cutting step in said second direction being initiated at a corner of said other slab and said acute angles being equal, said cutting steps being performed with a double-edge blade having its edges parallel to each other and arranged at said equal acute angles, said cutting step in said one direction being effected by one edge of said blade when said blade is moved in said one direction and said cutting step in said second direction being effected by the other edge of said blade when said blade is moved in said second direction.

14. The method of claim 13 in which said blade prevents said other slab from being projected while said first slab is being cut and vice versa.

15. A method of severing first and second frozen slabs of fish or the like into individual sticks comprising the steps of arranging said first and second slabs in a generally parallel and vertical relation, causing said first slab to move gravitationally downwardly so that the lower end thereof resides in a plane which is a predetermined distance beneath the lower end of said second slab, cutting in one direction a first stick from the lower end of said first slab, causing said second slab to move gravitationally downwardly so that the lower end thereof resides in said plane, and cutting in a second direction substantially opposite to said first direction a second stick from said second slab.

16. The method of claim 15 in which said first and second slabs have a rectangular cross section providing a relatively wide side and a relatively narrow side so as to determine the length and width, respectively, of said sticks, the location of said plane determining the thickness of said sticks.

17. The method of claim 16 in which each of said cutting steps is initiated at a corner of said slabs determined by one wide side and its juncture with a narrow side, and each of said cutting steps is continued through each slab at an acute angle to said one wide side to sever said sticks from said slabs.

18. The method of claim 15 including the step of raising or lowering said plane to vary the thickness of said sticks.

19. Apparatus for severing frozen slabs of fish or the like into individual sticks comprising means for holding a pair of frozen slabs in a generally parallel and vertical relation, a table at an elevation beneath said holding means, means movable in one horizontal direction for cutting a first stick from one of said pair of slabs when the lower end of said one slab is resting on said table, and means movable in a second horizontal direction substantially opposite to said first direction for cutting a second stick from the other of said pair of slabs when the lower end of said other slab is resting on said table.

20. The apparatus of claim 19 in which said holding means spaces said slabs in a lateral direction, and said one direction and said second direction are at an angle with respect to said lateral direction.

21. The apparatus of claim 20 in which said angles are equal and at an acute angle with respect to a line extending perpendicularly to said lateral direction.

22. Apparatus for severing frozen slabs of fish or the like into individual sticks comprising means for holding a pair of frozen slabs in a generally parallel relation, means movable in one direction for cutting a first stick from one of said pair of slabs, means movable in a second direction substantially opposite to said first direction for cutting a second stick from the other of said pair of slabs, said holding means spacing said slabs in a lateral direction, said one cutting direction and said second cutting direction being at an angle with respect to said lateral direction, said angles being equal and at an acute angle with respect to a line extending perpendicularly to said lateral direction, and a blade having knife edges extending along opposite sides thereof, one of said knife edges constituting said means for cutting said first stick and the other of said knife edges constituting said means for cutting said second stick.

23. The apparatus of claim 22 in which said pair of slabs are vertically arranged and said blade moves in a horizontal plane, the lower end of said other slab resting on said blade while said blade is cutting said one slab and the lower end of said one slab resting on said blade while said blade is cutting said other slab.

24. The apparatus of claim 23 including a horizontal table at an elevation beneath said blade, the lower end of said one slab resting on said table when said one slab is being cut by said blade and the lower end of said other slab resting on said table when said other slab is being cut by said blade.

25. The apparatus of claim 24 in which said table moves in unison with said blade.

26. The apparatus of claim 24 including means for adjusting the elevation of said table relative to said blade.

27. Apparatus for severing frozen slabs of fish or the like into individual sticks comprising means for holding a pair of frozen slabs in a vertical, side-by-side relation, blade means movable in a horizontal plane beneath said holding means to cut a stick from the lower end of one of said pair of slabs when said blade means is advanced in one direction and to cut a stick from the lower end of the other of said pair of slabs when said blade means is retracted in an opposite direction.

28. The apparatus of claim 27 in which said holding means includes vertical tube means providing two closely adjacent open-ended compartments, one of said slabs being slidably received in one of said compartments and the other of said slabs being slidably received in the second of said compartments.

29. The apparatus of claim 28 in which said tube means constitutes a tube having a central partition forming said first and second open-ended compartments, and said blade means includes a relatively flat blade having a knife edge extending along each side thereof, the upper surface of said blade being in substantially the same plane as the lower end of said tube.

30. The apparatus of claim 29 including means beneath said tube for maintaining said blade in the same plane as the lower end of said tube.

31. The apparatus of claim 30 in which said means for maintaining said blade in the same plane as the lower end of said tube includes a plate fastened to said tube, said plate having horizontal surfaces over which said blade slides.

32. The apparatus of claim 31 in which said plate has spaced vertical surfaces between which said blade slides.

33. The apparatus of claim 32 in which said vertical surfaces are in vertical alignment beneath the laterally spaced sides of said tube.

34. The apparatus of claim 33 in which said plate has additional vertical surfaces in vertical alignment between longitudinally spaced sides of said tube, said additional surfaces extending downwardly from said horizontal surfaces over which said blade slides.

35. Apparatus for severing a pair of frozen slabs of fish or the like into individual fish sticks comprising a blade having a knife edge along opposite sides thereof, means for moving said blade in a direction to sever a first stick from the end of one of said slabs, and means for moving said blade in a reverse direction to sever a second fish stick from the end of the other of said slabs.

36. The apparatus of claim 35 including vertical tube means for slidably containing said pair of slabs in a parallel relation therein, and means constraining said blade for movement in a horizontal plane beneath said tube means, said severing directions residing in said horizontal plane.

37. The apparatus of claim 36 including a horizontal table beneath said blade having openings therein through which said first and second sticks gravitationally drop after being severed from said slabs.

38. The apparatus of claim 37 including additional means constraining said blade for movement at an angle with respect to said tube means.

39. The apparatus of claim 38 in which one of said openings in said table is located so as to permit said first stick to drop therethrough when said blade is at one end of its stoke and the other of said openings is located in said table so that said second stick drops therethrough when said blade is at the opposite end of its stroke.

40. The apparatus of claim 39 in which the upper surface of said table is recessed between said openings in an amount corresponding to the thickness of said blade.

41. The apparatus of claim 40 including means for raising and lowering said table relative to said blade, and means for clamping said table at its adjusted elevation.

42. The apparatus of claim 41 in which said clamping means includes coacting wedges and a hydraulic or pneumatic cylinder for relatively moving said wedges in a direction to effect said clamping action.

43. The apparatus of claim 40 including means beneath said table for collecting said first and second sticks.

44. The apparatus of claim 43 in which said collecting means includes a pair of angled troughs.

45. The apparatus of claim 44 including a pusher member for each of said angled troughs, and means for actuating said pushers in a direction to push said first and second sticks from said angled troughs.

46. The apparatus of claim 45 including means mechanically connecting said actuating means for said pushers with said means for moving said blade.

47. The apparatus of claim 46 including fixed means beneath said tube means and located at either side thereof for absorbing the cutting forces of said blade when severing said first stick and also when severing said second stick.

48. Apparatus for severing frozen slabs of fish or the like into a number of individual fish sticks comprising a magazine including a plurality of vertically disposed and laterally spaced tube means providing first and second closely adjacent open-ended vertical compartments for slidably containing therein pairs of frozen fish slabs or the like, a cutter assembly, means for advancing and retracting said cutter assembly in a horizontal direction beneath said magazine for simultaneously severing first fish sticks from those slabs contained in said first open-ended compartments and for simultaneously severing second fish sticks from those slabs contained in said second open-ended compartments.

49. The apparatus of claim 48 including collecting means beneath said cutter assembly into which said various first and second fish sticks gravitationally drop after being severed from said slabs.

50. The apparatus of claim 49 including pusher means for removing said fish sticks from said collecting means.

51. The apparatus of claim 50 including a conveyer assembly, said pusher means pushing said fish sticks onto said conveyor assembly.

52. The apparatus of claim 51 including drive means for said cutter assembly and for said pusher means so that the movement of said pusher means is in accordance with the movement of said cutter assembly.

53. The apparatus of claim 52 including independent drive means for said conveyor assembly so that said conveyor assembly can be operated at a speed independent of the operation of said cutter assembly and said pusher means.

54. Apparatus for severing slabs of fish or the like into a number of individual fish sticks comprising a vertical magazine for slidably containing therein vertically arrayed frozen fish slabs or the like, a blade carrier movable at a horizontal angle beneath said magazine, said carrier having a double-edged blade for each two slabs contained in said magazine, one of said edges of each blade severing a first fish stick from one of each two slabs when said carrier is advanced at said horizontal angle in one direction and the other of said edges severing a second fish stick from the other of each two slabs when said carrier is retracted at said horizontal angle in an opposite direction, means against which said first fish sticks bear to absorb the severing thrust when said carrier is advanced in said one direction, and means against which said second fish sticks bear to absorb the severing thrust when said carrier is retracted in said opposite direction.

55. The apparatus of claim 54 including means against which said blades bear to absorb any downward deflection of said blades as said carrier is advanced and retracted.

56. The apparatus of claim 55 including means spaced beneath said magazine against which the lower faces of said first and second fish sticks bear as said carrier is advanced and retracted.

57. The apparatus of claim 56 in which said last-mentioned means and said carrier are advanced and retracted in unison.

58. The apparatus of claim 57 in which said last-mentioned means includes a horizontal table having a first set of openings therein through which said first fish sticks fall upon being severed and a second set of openings therein through which said second fish sticks fall upon being severed.

59. The apparatus of claim 58 in which said table is recessed downwardly between each of said first and second openings an amount corresponding to the thickness of said blades.

60. The apparatus of claim 59 in which said blades are mounted to said carrier at a horizontal angle supplementing said horizontal angle at which said carrier moves.

61. A method of severing a number of frozen slabs of fish or the like having a rectangular cross section into a plurality of sticks comprising the steps of vertically arranging said slabs in laterally spaced pairs, advancing one end of a correspondingly positioned slab of each pair of slabs against a substantially rigid horizontal surface, substantially cutting at an elevation above said horizontal surface and in one angular direction a stick from the lower end of said one correspondingly positioned slab of each pair, advancing one end of the other correspondingly positioned pair of slabs against said horizontal surface, and simultaneously cutting in a reverse angular direction and at said same elevation a stick from the lower end of the other correspondingly positioned slab of each pair.

* * * * *